US008720330B1

(12) United States Patent
Koenig

(10) Patent No.: US 8,720,330 B1
(45) Date of Patent: May 13, 2014

(54) SYSTEM AND METHOD FOR ADJUSTING AND COOLING A DENSIFIER

(76) Inventor: Larry E. Koenig, Groveport, OH (US)

( * ) Notice: Subject to any disclaimer, the term of this patent is extended or adjusted under 35 U.S.C. 154(b) by 816 days.

(21) Appl. No.: 12/846,471

(22) Filed: Jul. 29, 2010

Related U.S. Application Data

(60) Provisional application No. 61/229,527, filed on Jul. 29, 2009.

(51) Int. Cl.
*B30B 15/34* (2006.01)
*B30B 3/00* (2006.01)

(52) U.S. Cl.
USPC ..... 100/38; 100/48; 100/337; 100/340

(58) Field of Classification Search
USPC ..... 100/117, 145, 146, 147, 148, 150, 337, 100/338, 339, 340, 38, 43, 48; 210/248, 210/402, 413, 414, 415; 241/260.1
See application file for complete search history.

(56) References Cited

U.S. PATENT DOCUMENTS

| | | | | |
|---|---|---|---|---|
| 728,516 | A | | 5/1903 | Trabue |
| 829,315 | A | | 8/1906 | Anderson |
| 1,221,054 | A | | 4/1917 | Hyatt |
| 1,506,036 | A | | 8/1924 | Willmarth |
| 2,470,278 | A | | 5/1949 | West |
| 2,576,784 | A | | 11/1951 | Galen |
| 2,615,387 | A | | 10/1952 | Messing |
| 2,823,603 | A | | 2/1958 | Collins |
| 2,902,922 | A | | 9/1959 | Williams |
| 2,982,201 | A | | 5/1961 | Raymond |
| 3,179,040 | A | | 4/1965 | Seltzer |
| 3,310,836 | A | * | 3/1967 | Nichols ..... 198/676 |
| 3,588,356 | A | | 6/1971 | Poux et al. |
| 3,787,830 | A | | 1/1974 | Cato |
| 3,866,529 | A | | 2/1975 | Holman |
| 3,877,365 | A | | 4/1975 | Berggren |
| 3,938,434 | A | | 2/1976 | Cox |
| 3,982,483 | A | | 9/1976 | Bird et al. |
| 4,037,528 | A | | 7/1977 | White |
| 4,256,035 | A | | 3/1981 | Neufeldt |
| 4,289,067 | A | | 9/1981 | Hanak |
| 4,323,007 | A | | 4/1982 | Hunt et al. |
| 4,355,905 | A | | 10/1982 | St. Louis et al. |
| 4,516,492 | A | | 5/1985 | Olfert |
| 4,581,992 | A | * | 4/1986 | Koch ..... 100/117 |
| 4,636,127 | A | | 1/1987 | Olano et al. |
| 4,709,628 | A | | 12/1987 | Glowacki |
| 4,770,236 | A | | 9/1988 | Kulikowski |
| 4,807,816 | A | | 2/1989 | Ataka |

(Continued)

OTHER PUBLICATIONS

FKC Co., Ltd., Biosolids Dewatering, sales literature, 2 pages, found at www.fkcscrewpress.com, copyrighted 2009.

(Continued)

*Primary Examiner* — Jimmy T Nguyen
(74) *Attorney, Agent, or Firm* — Standley Law Group LLP

(57) ABSTRACT

Exemplary embodiments relate to a system for monitoring the temperature and adjusting a densifier having a compression screw. The system may include at least one temperature sensor adapted to monitor the temperature of or adjacent to the compression screw and a control system in electrical communication with a motor and the at least one temperature sensor and adapted to vary a speed or stop the compression screw based on input from the at least one temperature sensor.

14 Claims, 22 Drawing Sheets

(56) References Cited

U.S. PATENT DOCUMENTS

| | | | | |
|---|---|---|---|---|
| 4,852,817 | A | 8/1989 | Tipton | |
| 4,897,194 | A | 1/1990 | Olson | |
| 4,951,884 | A | 8/1990 | Koenig | |
| 5,108,040 | A | 4/1992 | Koenig | |
| 5,114,331 | A | 5/1992 | Umehara et al. | |
| 5,180,225 | A | 1/1993 | Piccolo, Sr. et al. | |
| 5,308,003 | A | 5/1994 | Koenig | |
| 5,373,923 | A | 12/1994 | Koenig | |
| 5,383,397 | A | 1/1995 | Battles | |
| 5,601,239 | A * | 2/1997 | Smith et al. | 241/29 |
| 5,611,268 | A | 3/1997 | Hamilton | |
| 5,662,035 | A | 9/1997 | Lee | |
| 5,735,199 | A | 4/1998 | Esau | |
| 5,819,643 | A | 10/1998 | Mcilwain | |
| RE36,023 | E | 1/1999 | Koenig | |
| 6,247,662 | B1 | 6/2001 | Hamilton | |
| 6,505,550 | B2 | 1/2003 | Hamilton | |
| 6,945,487 | B1 | 9/2005 | Obitz | |
| 7,226,213 | B2 | 6/2007 | Kraft | |
| 7,360,639 | B2 | 4/2008 | Sprouse et al. | |
| 7,523,996 | B1 | 4/2009 | Darst | |
| 7,631,596 | B2 | 12/2009 | Williams | |
| 7,740,325 | B1 | 6/2010 | Chen | |
| 7,828,482 | B2 | 11/2010 | Beausoleil et al. | |
| 7,851,585 | B2 | 12/2010 | Brison et al. | |
| 8,033,733 | B2 | 10/2011 | Lang | |
| 2004/0035804 | A1 * | 2/2004 | Bischof | 210/770 |
| 2005/0069446 | A1 | 3/2005 | Kriehn | |
| 2007/0214971 | A1 * | 9/2007 | Williams et al. | 100/149 |
| 2008/0121497 | A1 | 5/2008 | Esterson et al. | |
| 2010/0266230 | A1 | 10/2010 | Hong | |

OTHER PUBLICATIONS

Runi Danish Engineering, SK240, sales literature, 1 page, found at www.runi.dk, copyrighted 2009.

Runi Danish Engineering, Screw Compactor, product information, 2 pages, found at www.compactor-runi.com, Apr. 19, 2011.

PolyMax, Polystyrene Foam Densifier, product information, 1 page, found at www.polyman5000.com, copyrighted 2006.

Intcorecycling.com, GreenMax Recycling Machine, product information, 1 page, found at www.intcorecycling.com, copyrighted 2009-2010.

Foam Equipment + Consulting Co., Heger Recycling Equipment, sales literature, 3 pages, found at www.foamequipment.com/heger.com, copyrighted 2011.

RecycleTech Corp., RecycleTech—The Environment Savers, company information, 1 page, found at www.recycletechno.com, copyrighted 2009.

Intcorecycling.com, GreenMax Recycling Machine, product information, 2 pages, found at www.intcorecycling.com, copyrighted 2009-2010.

Sebright Products, Inc., Bright Technologies—Innovators in Dewatering Equipment Technologies, product information, 2 pages, found at www.brightbeltpress.com, copyrighted 2006.

* cited by examiner

SECTION A-A
A
A
600
602
610
612
614
616
620
622
624
626
627
628
630
632

620
622
616
624
652
628
632
600
602
616

628
600
610
614
612
654
622

624
622
SECTION A-A
660
632
658
656

616
622
624
652

616
652
A
A
612
610

SECTION A-A

SYSTEM AND METHOD FOR ADJUSTING AND COOLING A DENSIFIER

CROSS-REFERENCE TO RELATED APPLICATIONS

This application claims the benefit of U.S. Provisional Application No. 61/229,527, filed Jul. 29, 2009, which is hereby incorporated by reference as if fully recited herein.

BACKGROUND AND SUMMARY OF THE INVENTION

Exemplary embodiments of the invention are related to a densifier. More particularly, exemplary embodiments include a system that may be associated with a densifier that facilitates cooling of mechanical components of the densifier and prevents the densified material from plasticizing or melting during the densification process.

The amount of materials ending up in landfills is continuously increasing. As the scarcity of landfill space increases, along with more stringent environmental regulations, there have been increased efforts to reduce the amount of waste produced by individuals, in addition to an increased effort to recycle materials. Many different processes and machines have been developed to facilitate combating this ever-increasing problem.

One of the major contributing materials to landfill overflow are plastics. Additionally, certain types of lightweight plastics, such as, for example, expanded polystyrene (EPS), extruded polystyrene foam, and expanded polypropylene foam are not easily recycled because of their light weight and low scrap value. Many plastics take a very long period of time to biodegrade, if they biodegrade. These types of plastics may also be resistant to photolysis. Furthermore, certain types of lightweight plastics may not only float on water, but may also blow in the wind, causing an abundant amount of litter, especially along shores and waterways.

To combat the littering problem that comes with the use of plastics, different machines and methods of recycling have been developed. This is especially true regarding foamed plastics that typically require an extra step of densifying the foamed plastic. Different machines and methods have been developed to facilitate densification of plastics and other materials that may be recycled. Densification may facilitate the reduction of pentane gas dangers. Also, the densification process may reduce storage requirements and reduce hauling and/or handling costs.

There are currently three different types of densification methods that may be used to densify EPS and other plastics: heat extrusion, ram compaction, and screw compaction using an auger or compactor/compression screw. The known screw densifiers and related methods are less than ideal for densifying or compacting materials. One of the main problems that occur during the densifying process is that the mechanical components used to contact the plastic throughout the screw densification process may heat to undesired levels. This is especially true when known screw densifiers continuously run for extended periods of time. Additionally, another problem that may occur in known densifiers is that the density and/or size of logs or bales produced may fluctuate out of a desired range, producing bales or logs with unwanted characteristics.

Densifiers that use screw compaction have an especially inherent problem with material melt or plasticizing of the material due to the high heat. This occurs when the coefficient of friction between the material and typically the end surface of the compression screw generates high temperatures. Thus, plastics and other materials that have low melt points may be particularly vulnerable to melting during operation of known densifiers. For example, the unwanted temperature of the compression screw may be around 300 degrees Fahrenheit, which may be when the plasticizing of the material occurs. With many materials, it is highly undesirable for the materials to melt during the densification process because the melting may change the composition and/or properties of the material. For example, melting the material may change its functional properties, which may limit its future uses and hence reduce its value. Also, melting the material may change the characteristics of the output (e.g., the density or size of the log) of the densification process, which may reduce the quality of the output and/or impair the operation of the densifier. Also, plasticizing of the material may eliminate or impair the ability of the screw to transmit the force required to move the log of densified material through the compression chamber, ceasing continuous operation until the screw cools and can be cleaned of agglomerated material. Ceasing the continuous operation of the densifier may add extra time and cost to the recycling process.

Given the problems that exist with known screw densifiers, a densifier that incorporates a cooling system that minimizes the heat produced in the shaft and/or flights of the screw while operating the mechanical components of the densifier would be advantageous. Furthermore, providing a cooling system and method of cooling that provides an efficient means to cool the compression screw or other mechanical components is also desirable. Additionally, it is desired that the cooling system and method of cooling may allow the densifier to run on a substantially continuous basis by minimizing or eliminating a buildup of solid material mass caused by melting or plasticizing that could stop or slow down the densifier. Moreover, it is desired that a system is provided that is adapted to monitor when the temperature within the screw densifier reaches an undesired level and adjusts the densifier accordingly. Also, providing a system and method for producing a log or bale that is substantially uniform density and size throughout the length is desired. An exemplary embodiment of a system associated with a densifier that facilitates cooling of mechanical components of the densifier and adjusting the size and density of bales and/or logs produced may satisfy some or all of these needs or preferences.

Although this application may talk about a densifier that employs the method of screw compaction to densify plastics and other materials, the cooling system and method may be used in other applications other than densifying processes. Additionally, although this application may talk about implementing the cooling system with a densifying system that includes a screw compactor, exemplary embodiments of the cooling system may be implemented with any number of densifying, condensing, or other systems that require heat reduction. It should also be noted that the cooling fluid could be replaced by or alternated with a heating fluid for other applications that require heat.

Exemplary embodiments of the system and method may provide a compression screw for advancing plastic material having a hollowed shaft and chambers incorporated in at least one screw flight for the reception of fluid that is temperature controlled to maintain a temperature below that of the plasticizing or melt temperature of the material.

Exemplary embodiments of the system and method may also provide increased volume output of the compression screw through increased speed of the screw, which is facilitated by temperature control of at least the distal end and/or at least one compression flight of the screw.

Further, exemplary embodiments of the system and method may provide increased density of the output log or bale through additional force applied to the screw, which is facilitated by temperature control of at least the distal end and/or at least one the compression flight of the screw.

Exemplary embodiments of the system and method may also provide a novel combination in which a hollowed shaft and/or at least one flight are contained within the compression screw, whereby circulation of temperature controlled fluids may take place in the desired hollowed shaft and/or formed flight chambers.

Exemplary embodiments are directed to a system associated with a densifier adapted to cool mechanical components of the densifier and adjusting the size and density of bales and/or logs produced. Certain embodiments of the system may be used in densifiers of multiple geometries and sizes that are used to densify different materials. Unless expressly set forth, it is not intended to limit the invention to densifying particular materials.

In accordance with exemplary embodiments of the system associated with a densifier and method of use thereof, there is provided an interior hollowed shaft of the screw and a chamber in at least one flight of the screw for temperature control where fluids are circulated so as to maintain the temperature of the screw below the melt or plasticizing temperature of the material. Also, the system elements employed in conjunction with the hollowed shaft of the screw and the chamber in the screw flight(s) may include or be in association with thermo, speed, and/or density controls to control the circulation or lack of circulation of the fluids, temperature of the fluids, and/or volumetric output and density of the material.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Figure 1:
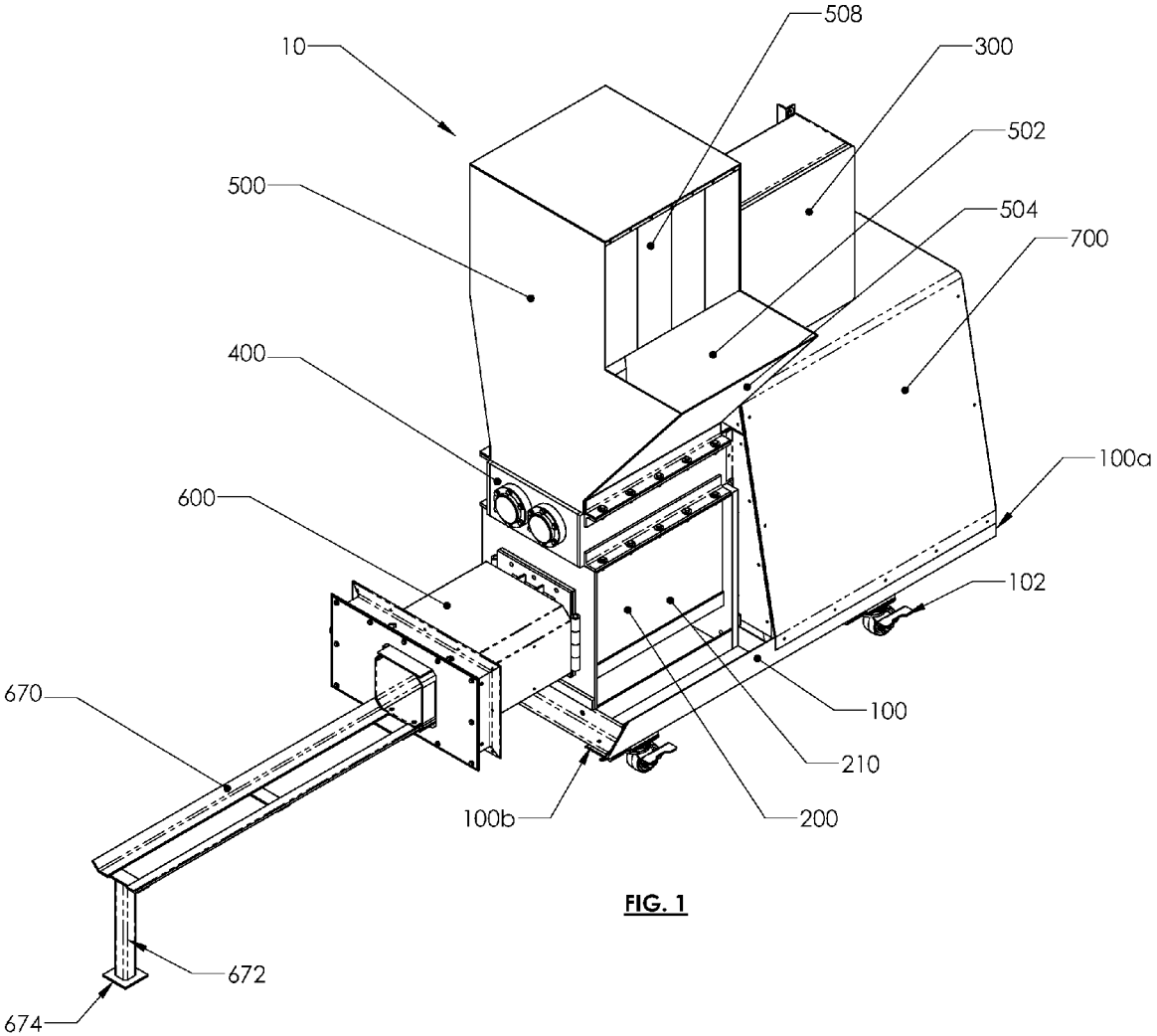
FIG. 1 is a perspective view of an exemplary embodiment of a densifier that includes a cooling system.

As seen in FIG. 1, exemplary embodiments of a densifier 10 that may be adapted to densify plastics or other materials are illustrated. Exemplary embodiments may include a frame 100 with a proximal end 100*a* and a distal end 100*b* such that rolling wheels 102 are attached to the frame 100. In other exemplary embodiments, the frame 100 may be adapted to mount or sit on different surfaces without the inclusion of wheels.

Figure 2:
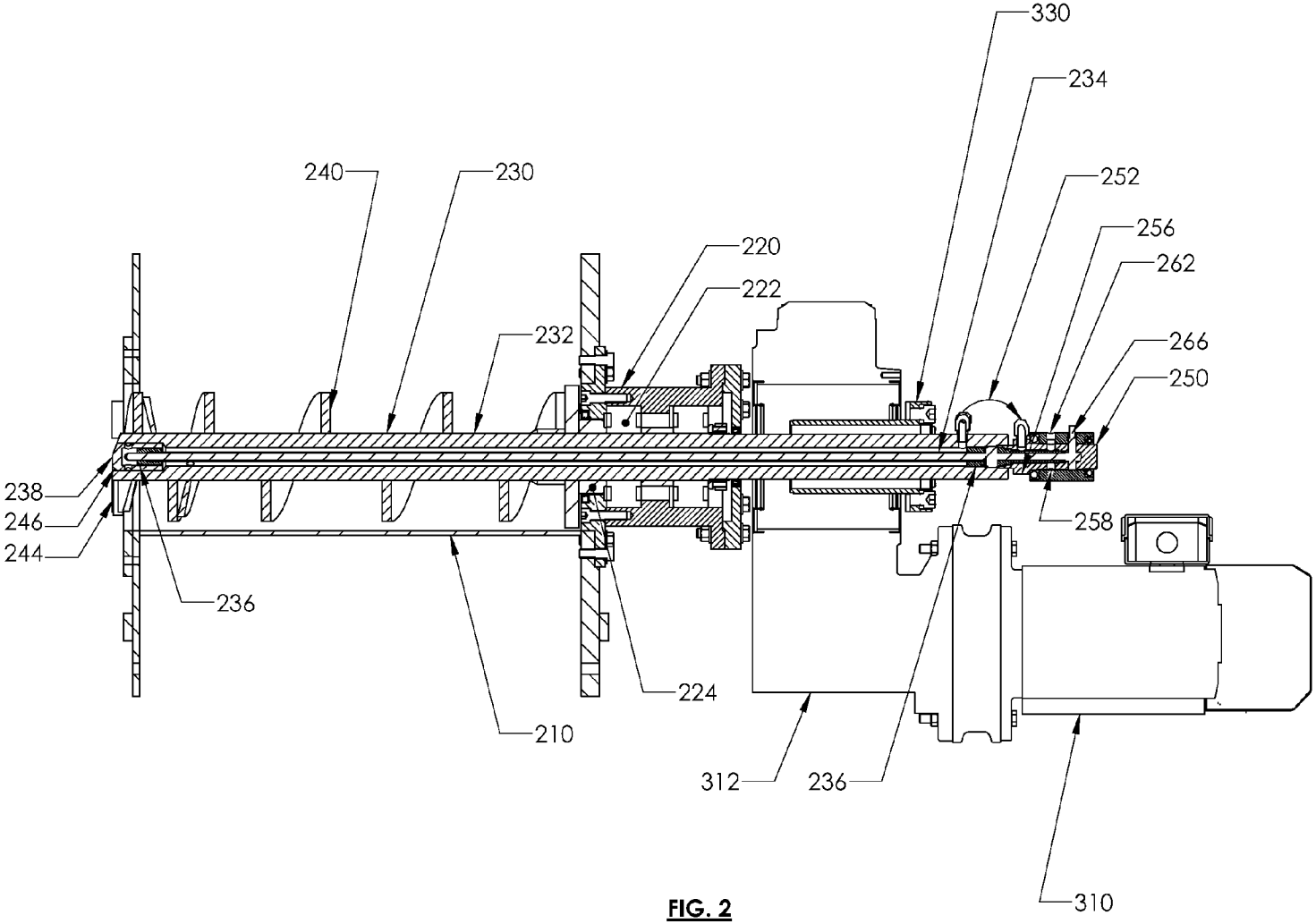
FIG. 2 is a partial sectional view of an exemplary embodiment of compactor module shaft assembly and drive unit.
Figures 3, 3A, 3B:
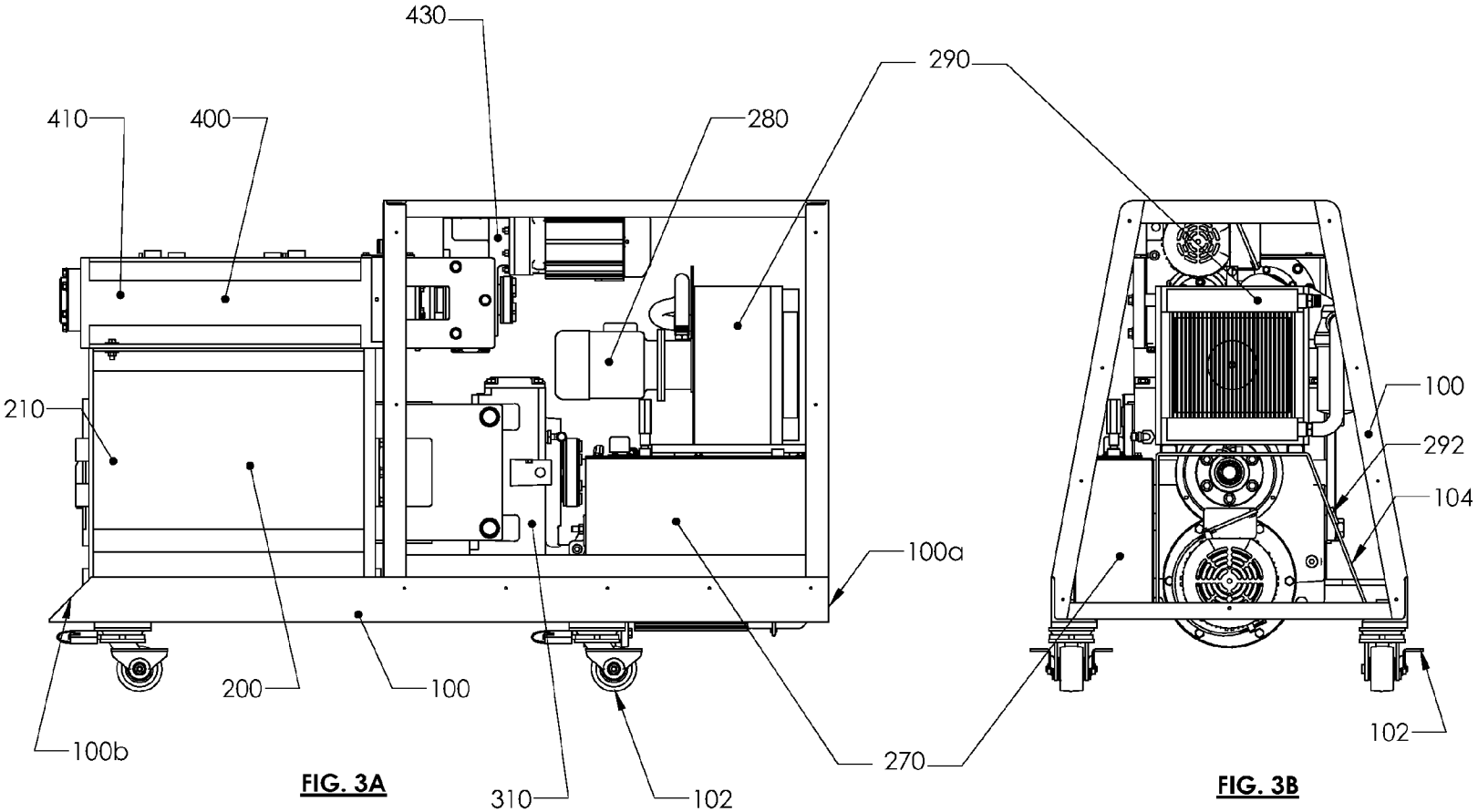
FIG. 3A is a side elevation view of an exemplary embodiment of a densifier that includes a cooling system.
FIG. 3B is a rear elevation view of an exemplary embodiment of a densifier that includes a cooling system.
Figure 6B:
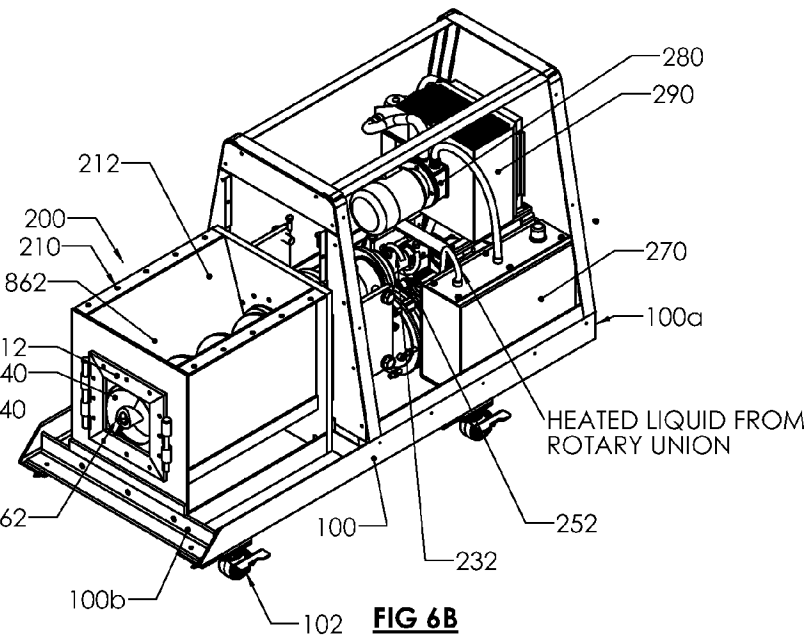
FIG. 6B is a perspective view of an exemplary embodiment of a densifier that includes a cooling system.
Figure 6A:
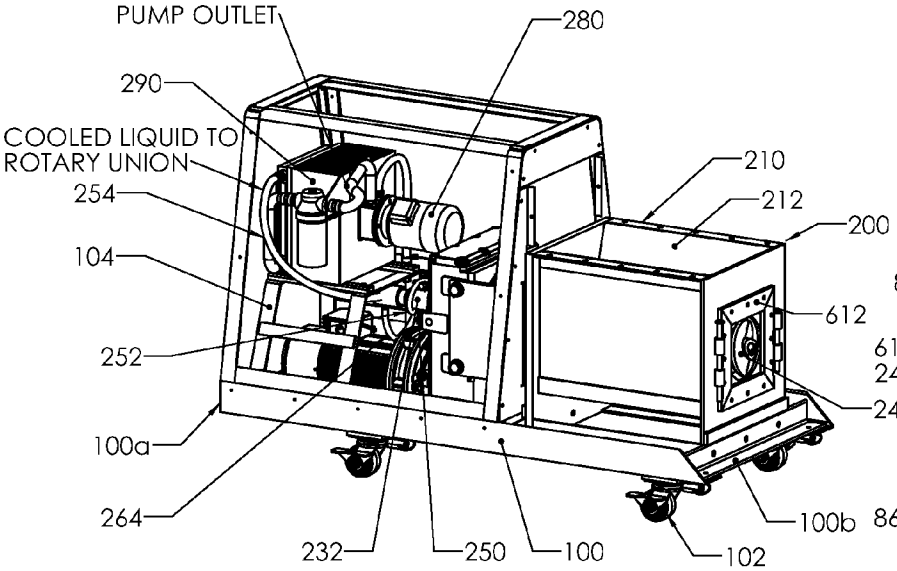
FIG. 6A is a perspective view of an exemplary embodiment of a densifier that includes a cooling system.
Figure 7A:
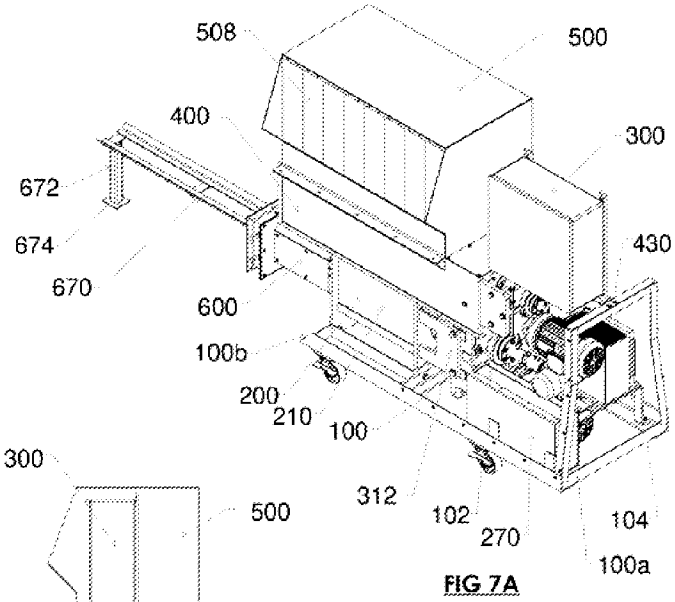
FIG. 7A is a perspective view of an exemplary embodiment of a densifier that includes a cooling system.
Figure 7D:
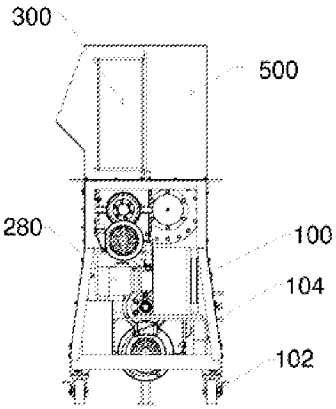
FIG. 7D is a rear elevation view of an exemplary embodiment of a densifier that includes a cooling system.
Figure 7C:
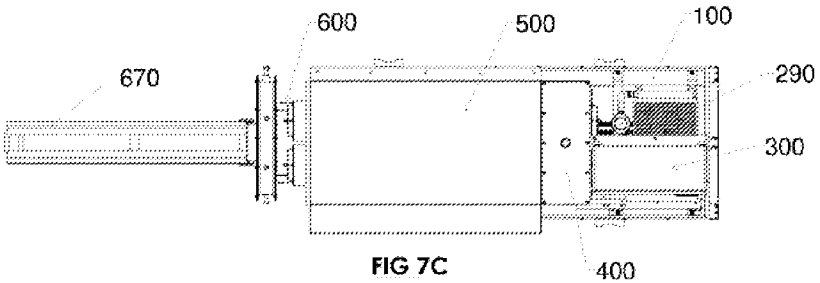
FIG. 7C is a top plan view of an exemplary embodiment of a densifier that includes a cooling system.
Figure 7B:
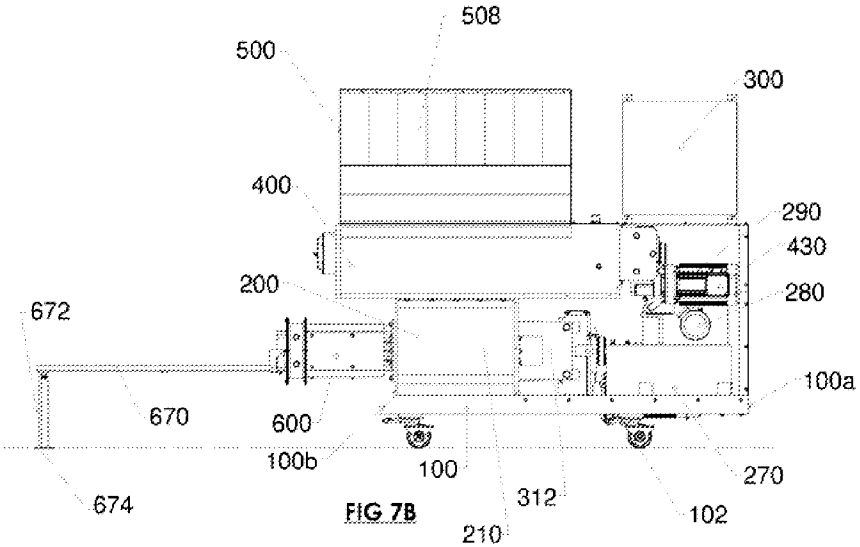
FIG. 7B is a side elevation view of an exemplary embodiment of a densifier that includes a cooling system.

Exemplary embodiments of the densifier 10 may include a compactor module 200 that is mounted to the frame 100, as seen in FIGS. 2 and 3A. The compactor module 200 includes a grinding chamber 210 that surrounds a compression screw 230 and other components. The walls of the grinding chamber 210 may be fabricated from materials that are strong enough to withstand the force exerted by the materials that are densified by the compression screw 230 during use of the densifier 10. One example of the grinding chamber 210 may be cuboid in geometry, with at least one opening 212 at the distal end of the grinding chamber 210 that allow the densified material to exit. In this example, the proximal end of the grinding chamber 210 may allow a compression screw shaft 232 to pass through the proximal wall, and the top of the grinding chamber 210 may allow material to enter the compactor module 200. However, in other embodiments, the grinding chamber 210 may be any number of geometries that allow suitable densification to occur. In this example, the grinding chamber 210 may have at least one additional opening 212, such as an opening in the top surface, as seen in FIGS. 6A and 6B, which allows material to enter the compactor module 200 for densification.

Exemplary embodiments of the grinding chamber 210 house a compression screw 230 that may be mounted to or otherwise extend generally between the distal wall and proximal wall 216 of the grinding chamber 210. In exemplary embodiments, the compression screw 230 may be secured to or otherwise in association with the grinding chamber 210 and/or frame by at least one bearing 222. In certain exemplary embodiments, the bearing 222 is contained in a bearing housing 220 that engages the proximal wall of the grinding chamber 210. The bearing housing 220 may be any number of geometries depending on the number and types of bearings used. However, the bearing housing 220 is substantially cuboid in this particular embodiment. Preferably, in some embodiments, at least a portion of the bearing housing 220 engages at least a portion of the proximal wall that may encircle the opening contained therein to assure that material does not exit the proximal end of the grinding chamber 210. In some embodiments, a gasket 224 or similar device may be placed between the bearing housing 220 and the proximal wall of the grinding chamber 210 to effectuate a seal.

Figure 12A:
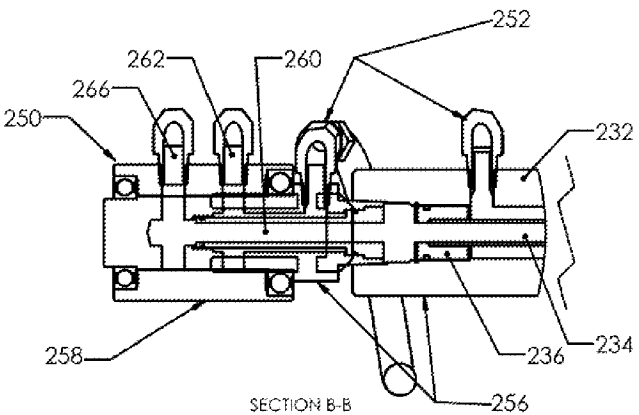
FIG. 12A is a distal end elevation view of an exemplary embodiment of a compression screw.
Figure 12B:
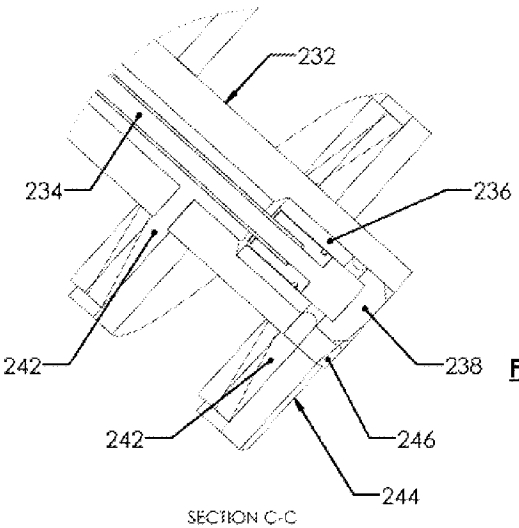
FIG. 12B is a partial sectional view of the compression screw of FIG. 12A taken along the line B-B, wherein the compression screw is in association with a rotary union.
Figure 12D:
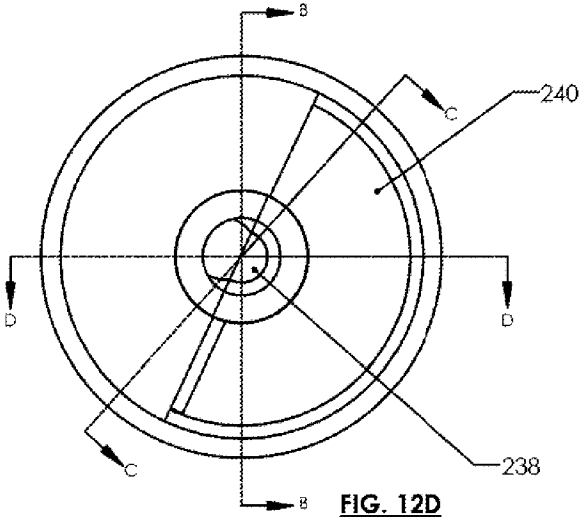
FIG. 12D is a partial sectional view of the proximal end of the compression screw of FIG. 12A taken along the line D-D, wherein the compression screw is in association with a rotary union.
Figure 12C:
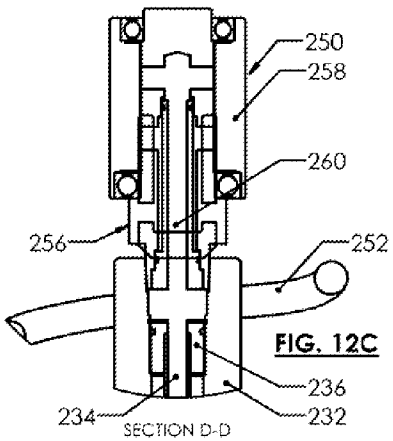
FIG. 12C is a partial sectional view of the compression screw of FIG. 12A taken along the line C-C.
Figure 13B:
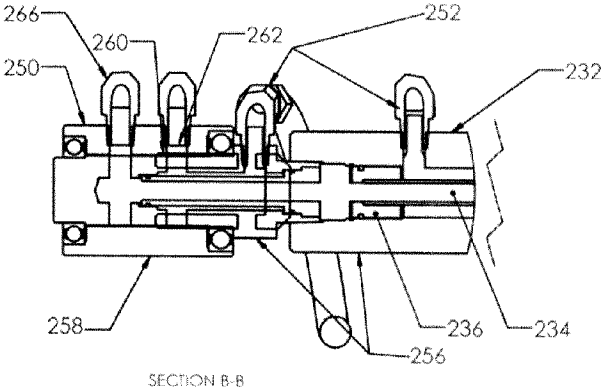
FIG. 13B is a partial sectional view of the compression screw of FIG. 13A taken along the line B-B, wherein the compression screw is in association with a rotary union.
Figure 13C:
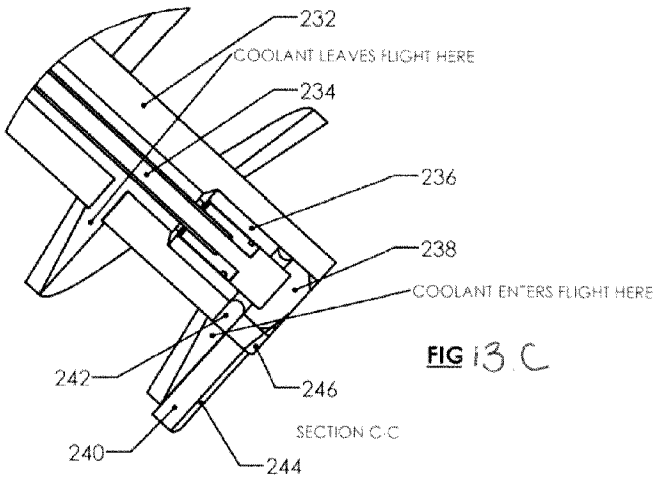
FIG. 13C is a partial sectional view of the compression screw of FIG. 13A taken along the line C-C.
Figure 13A:
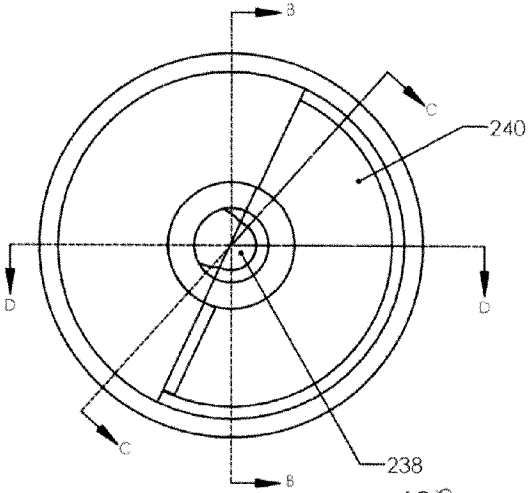
FIG. 13A is a distal end elevation view of an exemplary embodiment of a compression screw.
Figure 13D:
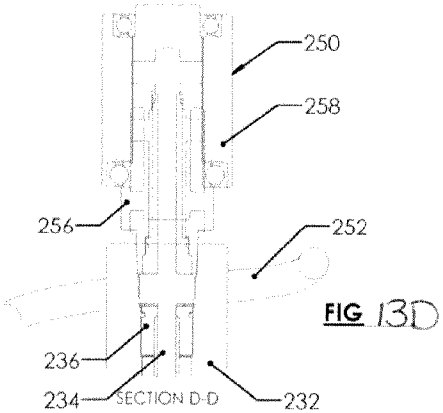
FIG. 13D is a partial sectional view of the compression screw of FIG. 13A taken along the line D-D, wherein the compression screw is in association with a rotary union.
Figure 14C:
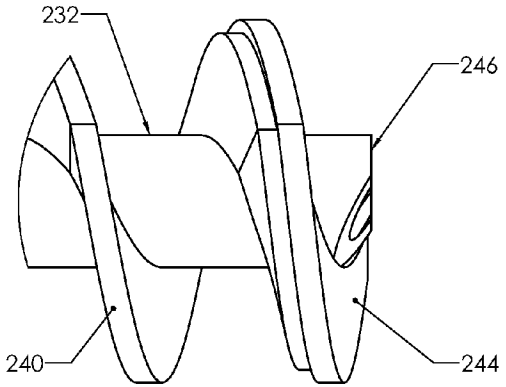
FIG. 14C is a side elevation view of an exemplary embodiment of a distal end of a compression screw.
Figure 14D:
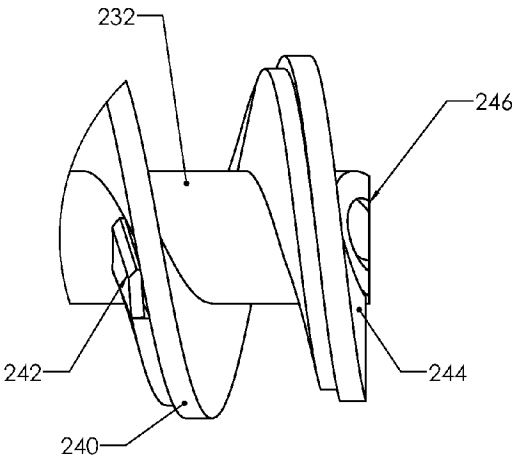
FIG. 14D is a side elevation view of an exemplary embodiment of a distal end of a compression screw.
Figure 14A:
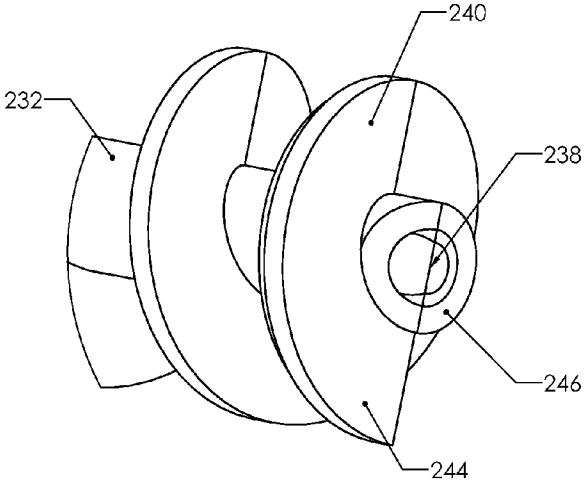
FIG. 14A is a perspective view of an exemplary embodiment of a distal end of a compression screw.
Figure 14B:
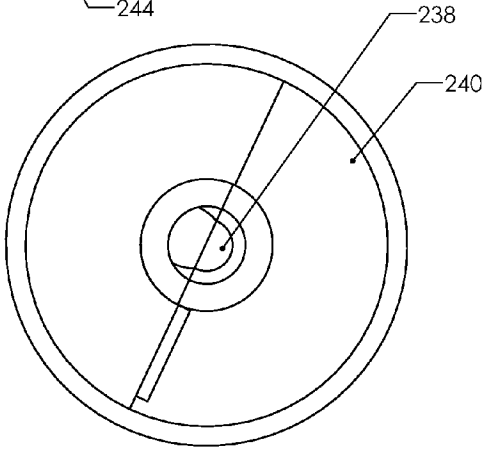
FIG. 14B is an end elevation view of an exemplary embodiment of a distal end of a compression screw.

In exemplary embodiments, such as seen in the examples in FIG. 2 and FIGS. 11A-11C, the compression screw 230 includes a hollowed shaft 232 through which a tubular body 234 may pass from the proximal to the distal end of the shaft 232. Typically, the cross-sectional area of the tubular body 234 is smaller than the inner diameter of the hollow shaft 232 to allow heated fluid to return the length of the shaft 232 between the outer wall of the tubular body 234 and the inner wall of the shaft 232, during operation of the densifier 10. In some exemplary embodiments, the tubular body 234 is attached within the shaft 232 by at least one holding member 236 located at the distal end of the shaft 232, and at least one holding member 236 located at the proximal end of the shaft 232. In exemplary embodiments, the holding members 236 (e.g., proximal and distal o-ring seals) may be inserted within the hollowed shaft 232 and engage at least a portion of the inner wall of the shaft 232 to effectuate securement of the tubular body 234 within the shaft 232 by a press fit or other suitable fit. In other embodiments, additional securing means may help facilitate securement of the tubular body 234 within the shaft 232. Furthermore, exemplary embodiments of the compression screw 230 may include a plug 238 situated within the distal end of the screw 230 to prohibit unwanted fluid flow into the distal end of the screw 230. In this exemplary embodiment, the plug 238 may be situated inside the shaft 232 to assist with diverting fluid flow into at least a flight 240, which is preferably situated closest to the distal end of the compression screw 230. An example of the plug 238 may also prevent the return flow of cooling fluid from going back into the distal end of the screw 230, such as seen in the example of FIGS. 12A and 12C. Although the plug 238 may be welded within the hollowed shaft 232 in some embodiments, other means of securing may be used.

The compression screw 230 may include one or more flights 240 in exemplary embodiments, such as seen in the examples of FIGS. 12C and 14A-14D. Preferably, at least one flight 240 includes a chamber 242 wherein fluid may flow through the flight 240 to cool at least the distal end of the compression screw 230. Typically, the distal end of the compression screw 230 produces the most heat during the operation of the densifier 10. Therefore, in most exemplary embodiments, the flight 240 located closest to the distal end of the compression screw 230 includes a chamber 242 that allows fluid to flow therein. However, in other embodiments, any number of flights 240 along the compression screw 230 may include a chamber 242 that allows fluid to flow therein to cool the compression screw 230. The chamber or chambers 242 contained within the flights 240 may be any number of geometries and may or may not be continuous along the entire length of the compression screw 230. In some exemplary embodiments, the chamber 242 may be substantially circular in cross-section area or any other suitable geometry to facilitate fluid flow. In some exemplary embodiments, the chamber 242 begins at a distal end portion of the flight 240, where it is in fluid association with the fluid exiting the plug 238. The chamber 242 may travel within the length of the flight 240, following the geometry of the flight 240 around the shaft 232 of the compression screw 230. The chamber 242 may then exit toward a proximal end portion of the flight 240 into the aforementioned area between the outer wall of the tubular body 234 and the inner wall of the hollowed shaft 232. In some exemplary embodiments wherein more than one flight 240 contains a chamber 242, the fluid may enter and exit multiple chambers 242 from the area between the outer wall of the tubular body 234 and the inner wall of the hollowed shaft 232 during operation of the densifier 10. Also, it should be recognized that the cooling fluid could alternatively enter a proximal end portion of a flight 240 and then exit at a distal end portion thereof. Such an embodiment could eliminate the need for a plug 238.

Unlike many types of known compression screws, the flights 240 in some exemplary embodiments that are located towards the distal end may not be conical or tapered in geometry. Instead, the flights 240 may have a flattened end 244 at the distal end in relationship with the flat end 246 of the shaft 232. The flattened ends 244 and 246 of the flights 240 and shaft 232 may help eliminate holes in bales or logs of materials produced by the densifier 10.

Exemplary embodiments of the shaft 232 of the compression screw 230 are connected with a rotary union 250 situated at the proximal end thereof that allows the fluid to flow from the rotating shaft 232 to return connections 252. One example of a rotary union 250 that may be used is the 9300 series of rotary unions fabricated by Talco, Inc. which has the website www.rotaryunions.net.

In exemplary embodiments, such as seen in the examples of FIGS. 12B, 12D, 13B, and 13D, a return connection 252 runs from the shaft 232 to the rotary union 250, through which heated cooling fluid travels during operation of the densifier 10. In some exemplary embodiments, depending upon the rotary union 250 used, the return connection 252 rotates along with the shaft 232 and a rotatable portion 256 of the rotary union 250 during operation of the densifier 10. During operation, the return cooling fluid may enter an interior hollow 260 of a relatively stationary portion 258 of the rotary union 250 and then exit an outlet 262 of the stationary portion 258 of the rotary union 250 that is in fluid association with the interior hollow portion 260. The outlet 262 may be connected to a fluid return line 264 that is in fluid association with a fluid reservoir 270 that may be attached to the frame 100.

Exemplary embodiments of the rotary union 250 may also include an inlet 266 that connects with a fluid supply line 254 that is in fluid association with a heat exchanger 290 and allows cooled fluid to flow from the heat exchanger 290 through the rotary union 250 and into the tubular body 234 contained within the shaft 232 of the compression screw 230.

Exemplary embodiments of the densifier 10 may include a fluid reservoir 270 connected to the frame 100. In this particular embodiment, the fluid reservoir 270 is located on the left side at the proximal end 100*a* of the frame. However, in other exemplary embodiments, the fluid reservoir 270 may be located at different locations on the frame 100, depending upon design characteristics and other needs. Furthermore, in some embodiments, the fluid reservoir 270 may not be located on the frame 100. For example, the reservoir 270 could be situated adjacent to the grinding chamber 210 to allow for more ventilation in another exemplary embodiment. In some embodiments, the fluid return line 264 that is in fluid association with the fluid reservoir 270 connects with a portion of the upper surface of the fluid reservoir 270 so that the fluid flows down into the reservoir with minimal required force. However, in other embodiments, the fluid return line 264 may be connected to any location of the fluid reservoir 270. The fluid reservoir 270 may have a number of different geometries that allow suitable operation of the densifier 10. In one example, the reservoir 270 is substantially cuboid. Also, in some exemplary embodiments, the bottom inner surface of the reservoir may be concave (not shown) to facilitate collection of the cooling fluid at a certain point within the reservoir. Furthermore, exemplary embodiments of the fluid reservoir 270 may include a screening device (not shown) that may help facilitate filtration of the cooling fluid to remove any undesired debris or particulates that may enter the cooling system during use.

A pump 280 is in fluid association with the fluid reservoir 270 and the heat exchanger 290 (via a line 267). Any number of fluid pumps may be used that allow suitable operation of the densifier 10. In some exemplary embodiments, the pump 280 is mounted on the heat exchanger 290. However, in other exemplary embodiments, the pump 280 may be mounted on the frame 100 or other suitable locations associated with the densifier 10. During operation, the pump 280 pulls cooling fluid from the fluid reservoir 270 and pushes the cooling fluid through the heat exchanger 290 and the rest of the cooling system to facilitate cooling of the compression screw 230.

In exemplary embodiments, a heat exchanger 290 is in fluid association with the pump 280 and the inlet of the rotary union 250 (through supply line 268). In some embodiments, the heat exchanger 290 may be mounted to the proximal end 100*a* of the frame 100 on mounting brackets 104, as seen in FIG. 3B, or secured in another suitable manner. In other exemplary embodiments, the heat exchanger 290 may be floor mounted (not shown). In some exemplary embodiments, the heat exchanger 290 is a fan-cooled air-over-liquid heat exchanger with an in-line pump and optional filter. However, in other examples, different types of heat exchangers may be used, depending on design characteristics and the environment in which the densifier is operated. Typically during operation, the heat exchanger 290 receives heated cooling fluid from the pump outlet 282 and emits cooled fluid to the inlet 266 of the rotary union 250.

Such as shown in FIG. 1, exemplary embodiments of the densifier 10 may include an electrical junction box 300 that may be mounted on the frame 100. However, the electrical junction box 300 may be positioned at other suitable locations associated with the densifier 10, including other enclosures. The electrical junction box 300 may be in electrical association with and facilitate the operation of components that utilize electricity included in exemplary embodiments of the densifier 10.

With reference to the example in FIG. 2, exemplary embodiments of the densifier 10 may include an electric motor 310 to turn the compression screw 230 that is mounted on the frame 100. In one example, the motor 310 is a dual-voltage three phase TEFC motor that is variable speed. However, in other exemplary embodiments, other motors may be used that are able to suitably rotate the compression screw 230, including motors that are operated by power sources other than electricity. However, an electric motor may be preferred because the electric motor may not emit any toxic emissions, unlike other motors that may be used. In some exemplary embodiments, a gearbox or reducer 312 may be in association with the motor 310 to allow a user to vary the rotation speed of the compression screw 230 during operation of the densifier 10. In one example, a hollow-shaft gearbox or reducer may be used. By including a gearbox or reducer, a smaller motor may be used to provide the required torque to suitably operate the densifier. In exemplary embodiments that include a gearbox or reducer 312, the gearbox or reducer 312 may be used in association with the proximal end of the compression screw shaft 232, between the rotary union 250 and the bearing housing 220. However, in other embodiments, the motor 310 and/or gearbox 312 may be in association with other portions of the compression screw 230 to facilitate rotation thereof. In some examples, a variable frequency drive (VFD) (not shown) may be used to control the rotational speed of the compression screw 230. In some embodiments, as seen in FIG. 2, a coupler 330 may facilitate the transfer of rotational movement from the motor 310 to the compression screw 230. In this example, a tapered shaft coupling is used, although other types of couplers may be used in other embodiments.

Figure 8A:
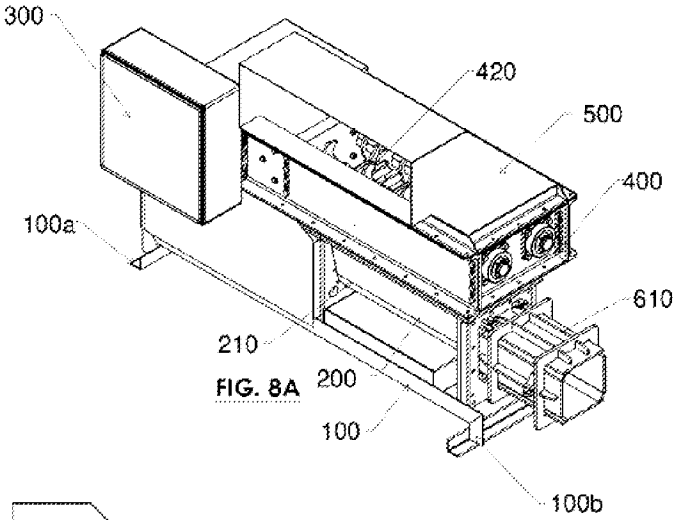
FIG. 8A is a perspective view of an exemplary embodiment of a densifier that includes a cooling system.
Figure 8D:
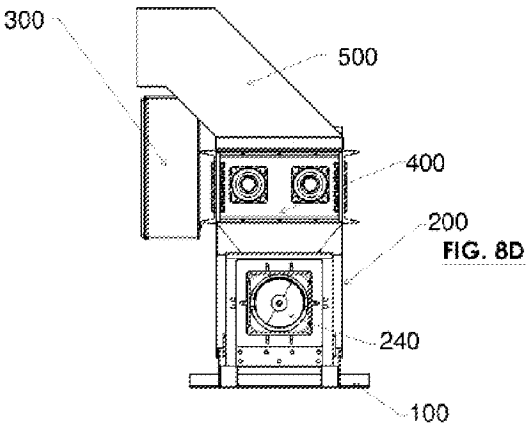
FIG. 8D is a front elevation view of an exemplary embodiment of a densifier that includes a cooling system.
Figure 8C:
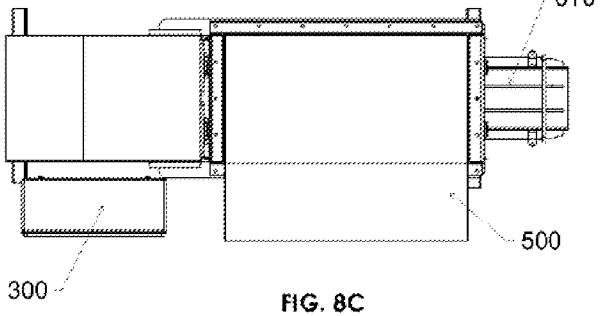
FIG. 8C is a top plan view of an exemplary embodiment of a densifier that includes a cooling system.
Figure 8B:
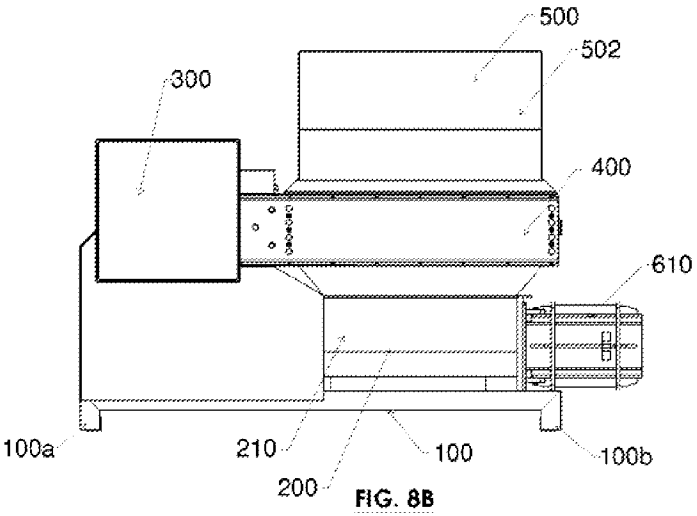
FIG. 8B is a side elevation view of an exemplary embodiment of a densifier that includes a cooling system.
Figure 9A:
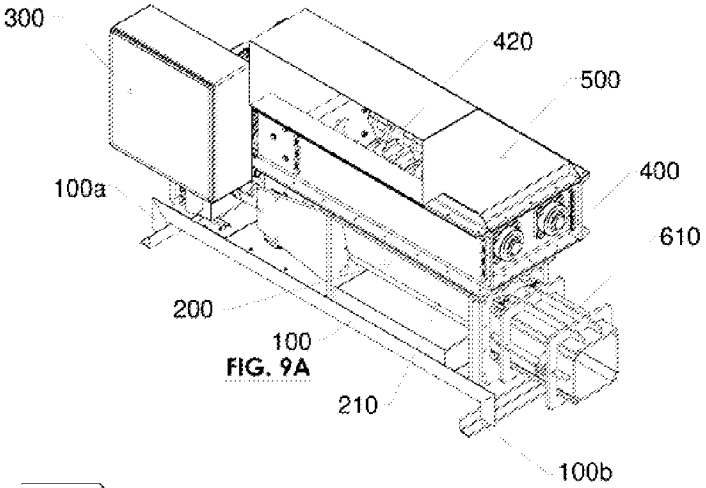
FIG. 9A is a perspective view of an exemplary embodiment of a densifier that includes a cooling system.
Figure 9D:
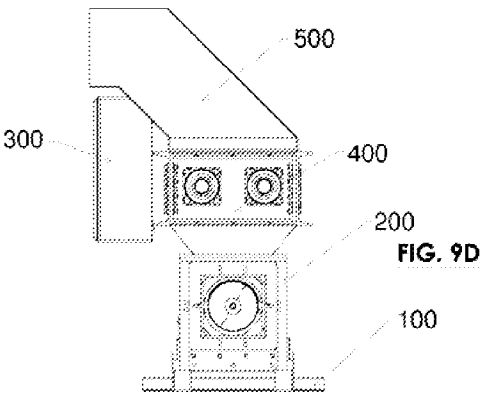
FIG. 9D is a front elevation view of an exemplary embodiment of a densifier that includes a cooling system.
Figure 9C:
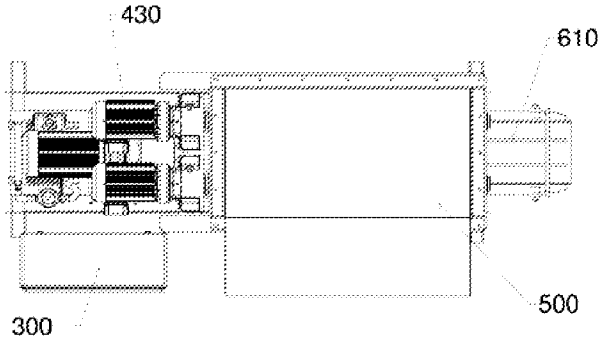
FIG. 9C is a top plan view of an exemplary embodiment of a densifier that includes a cooling system.
Figure 9B:
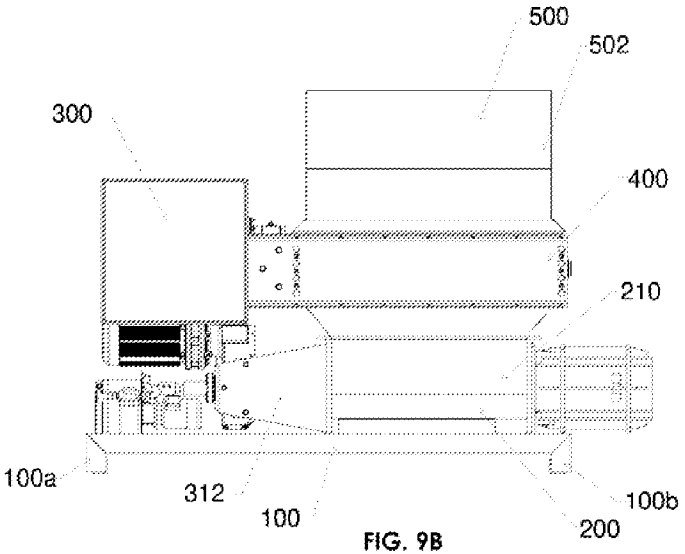
FIG. 9B is a side elevation view of an exemplary embodiment of a densifier that includes a cooling system.

Such as shown in the example of FIG. 3, an optional shredder module 400 may be included in exemplary embodiments. The shredder module 400 may be in association with at least a portion of the compactor module 200 and/or a portion of the frame 100. An opening in the lower face of the shredder module may connect to an opening 212 in the upper face of the compactor module 200 to allow material to pass through the shredder module 400 into the compactor module 200. Exemplary embodiments of the shedder module 400 may include an enclosure 410 that may be substantially the same cross-sectional geometry as the compactor module 200, when viewed in a plan view, to facilitate desired operation of the densifier. Exemplary embodiments of the shredder module 400 may include one or more shredding bodies 420 (see FIG. 8A) that are in mechanical association with and are driven by a shredding drive unit 430 that may be mounted on at least a portion of the frame 100. In some exemplary embodiments, the shredding bodies 420 are connected to the enclosure walls 410 of the shredder module 400. To reduce frictional forces, bearings located in the enclosure walls 410 may hold the shredding bodies 420 in position during operation. The shredding bodies 420 may have any number of geometries and cross-sectional areas that may facilitate shredding materials that pass through the shredding module 400. The shredding drive unit 430 may be a similar drive unit to the aforementioned motor 310 and gearbox/reducer 312 used to rotate the compression screw 230. In some embodiments, the shredding module 400 may not be included or situated above the compactor module 200. This is true in embodiments that may densify materials that do not require shredding before entering the compactor module 200. Also, the shredding process may be undertaken in a separate machine before the material enters exemplary embodiments of the densifier 10.

Figure 4B:
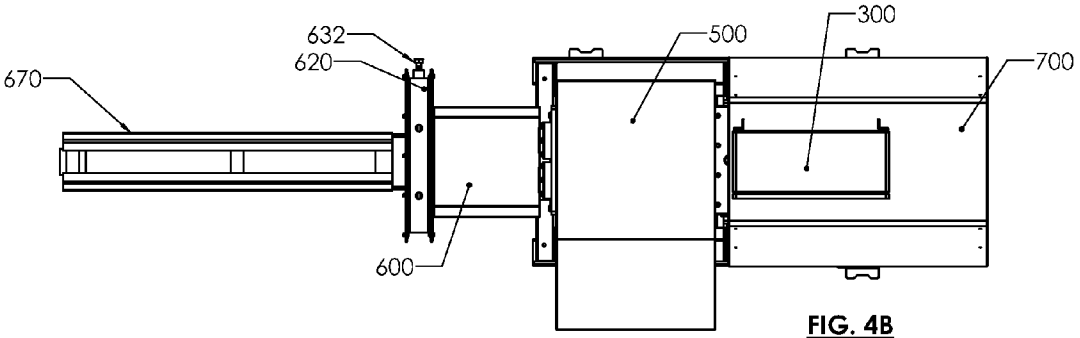
FIG. 4B is top plan view of an exemplary embodiment of a densifier that includes a cooling system.
Figure 4C:
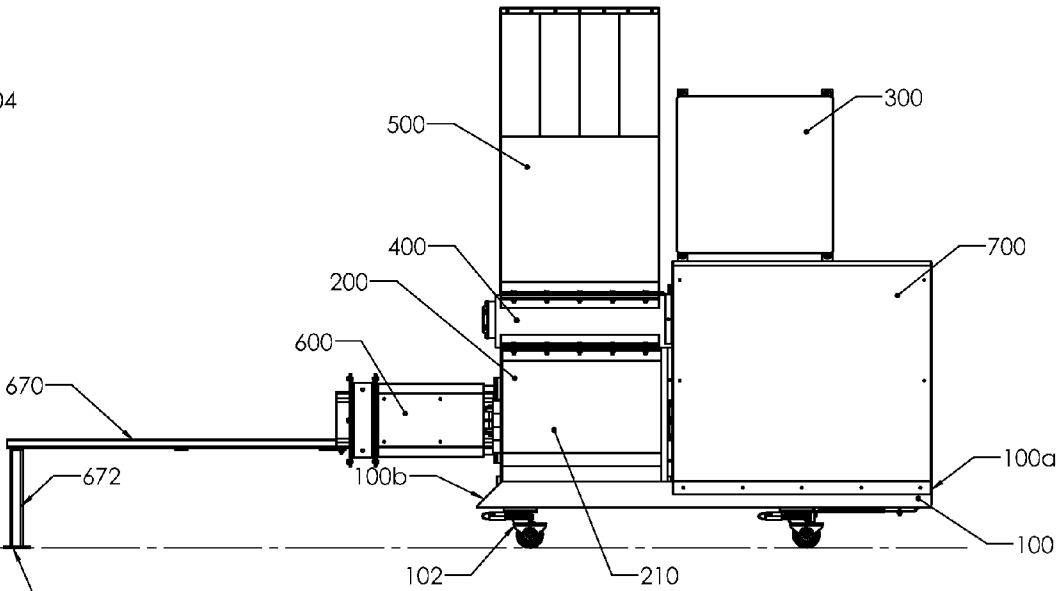
FIG. 4C is a side elevation view of an exemplary embodiment of a densifier that includes a cooling system.
Figure 4A:
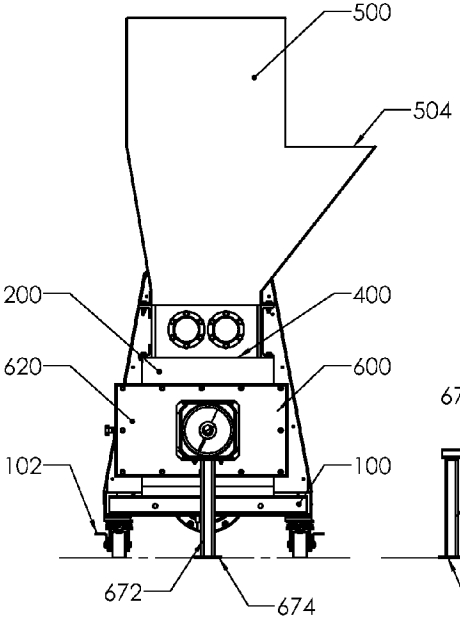
FIG. 4A is a front elevation view of an exemplary embodiment of a densifier that includes a cooling system.
Figure 5:
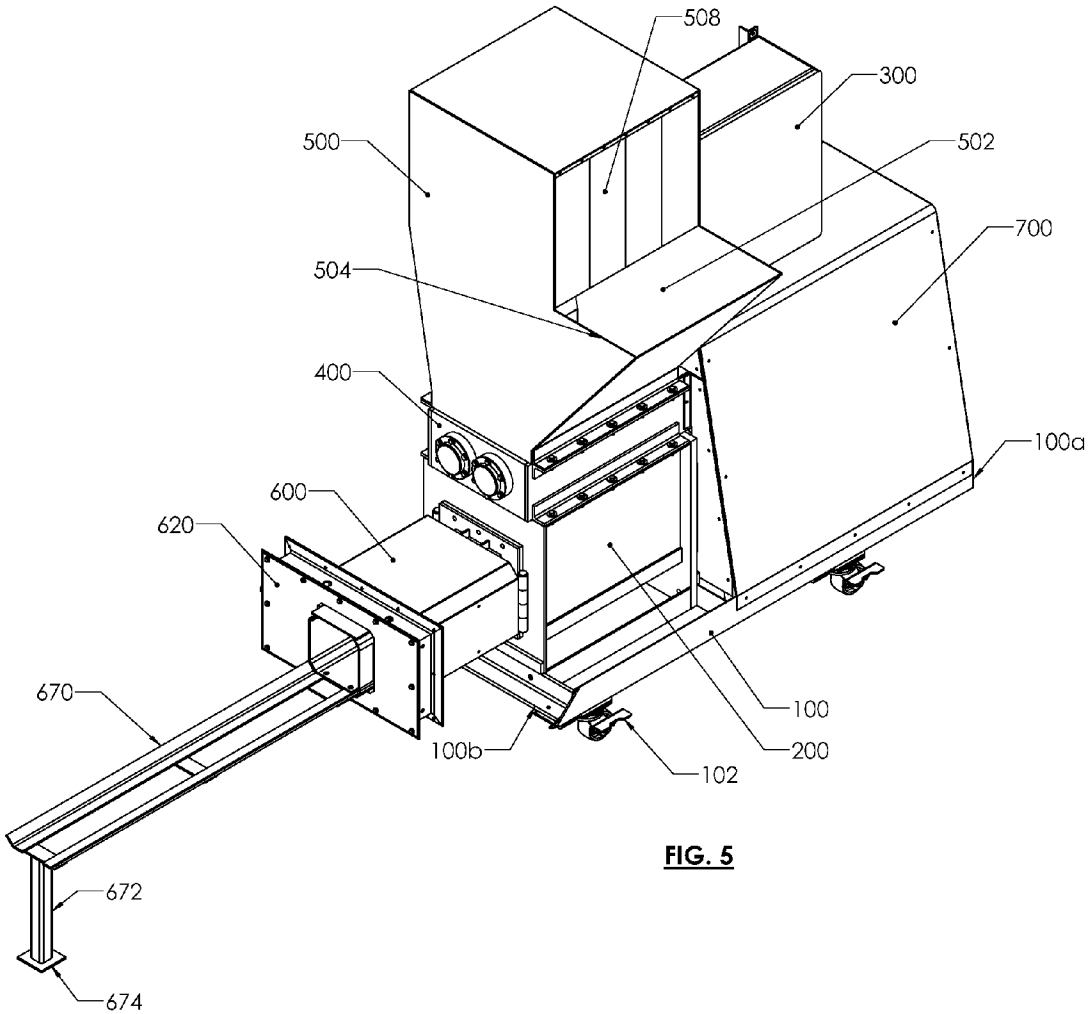
FIG. 5 is a perspective view of an exemplary embodiment of a densifier that includes a cooling system.

Some exemplary embodiments of the densifier 10 may include an infeed hopper 500, such as seen in the examples of FIGS. 4A-5 and 7A-10D. In exemplary embodiments that include the optional shredding module 400, at least a portion of the lower surface of the infeed hopper 500 may be mounted to engage at least the upper surface of the shredding module 400. In exemplary embodiments that do not include the optional shredding module 400, at least a portion of the lower surface of the infeed hopper 500 may be mounted to engage at least the upper surface of the compactor module 200. In other exemplary embodiments, an infeed hopper 500 may have any suitable association with the compactor module 200. Exemplary embodiments of the infeed hopper 500 may be substantially cuboid in geometry, with at least one opening 502 (see FIGS. 5 and 9B) on a side face of the hopper 500. Some exemplary embodiments may include more than one opening 502 on either the side or end faces of the infeed hopper 500. In some exemplary embodiments, such as shown in FIGS. 4A and 5 the opening 502 may include a protruding body 504 located on the lower portion of the opening 502 that facilitates loading of the infeed hopper 500 with material by allowing the material to slide down an inner face of the protruding body 504. The protruding body 504 may be integral with the infeed hopper 500 or may be attached to the infeed hopper. Exemplary embodiments of the infeed hopper 500 may further include at least one hopper flap 508. In one example, at least one hopper flap 508 may be swingingly attached to at least the upper edge of the opening 502, allowing the hopper flap to swing inward when material is loaded into the hopper. The at least one hopper flap 508 may help prevent material from leaving the infeed hopper 500 and/or shredder module 400 and/or compactor module 200 during the operation of the densifier. The at least one hopper flap 508 may be fabricated from various materials that allow the hopper flap to swing open during use thereof, which may include, but are not limited to: metals, rubber, plastics, etc.

Figures 15A, 15B:
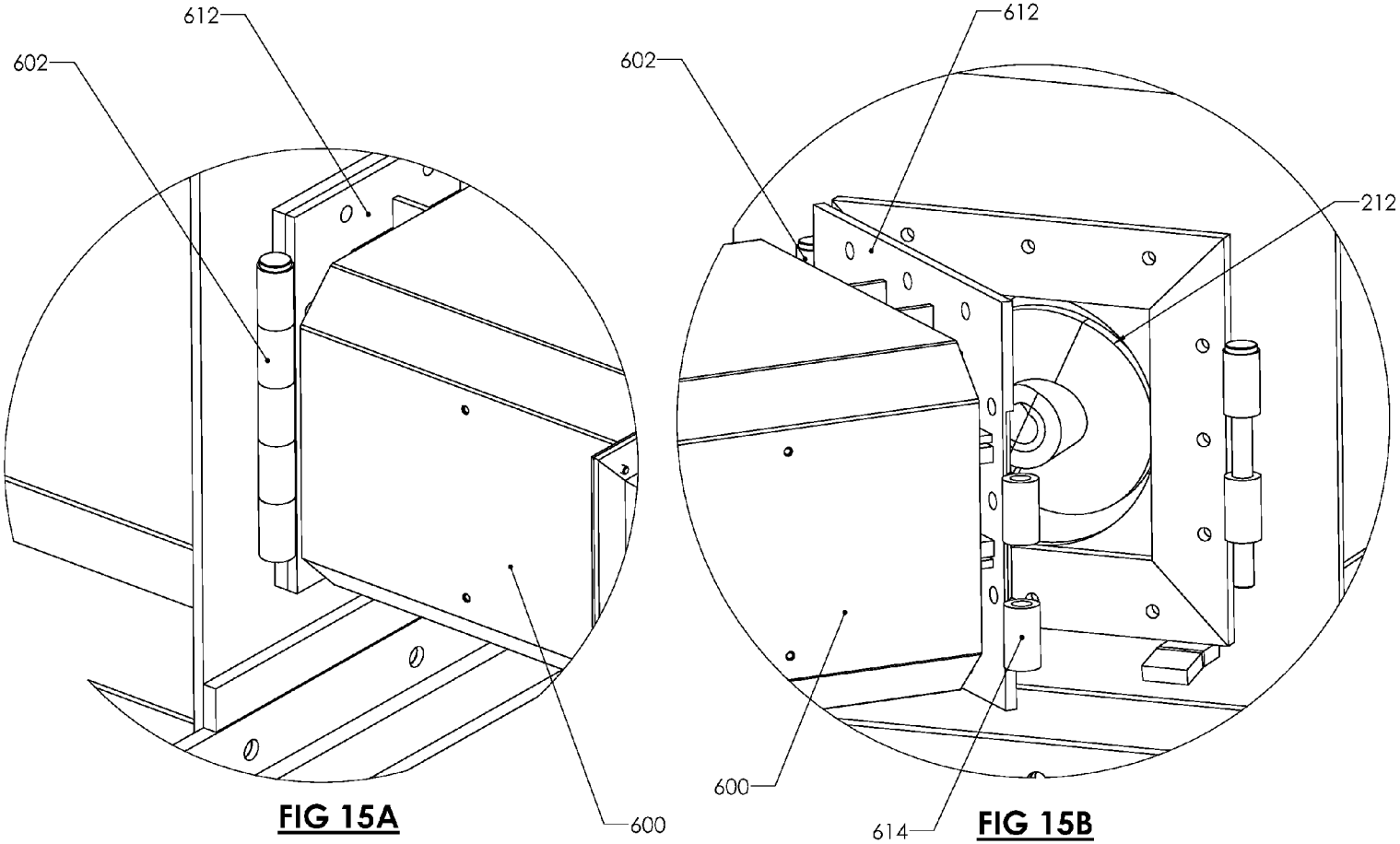
FIG. 15A is a partial perspective view of an exemplary embodiment of a connection between a compactor module and an extruder module.
FIG. 15B is a partial perspective view of an exemplary embodiment of a connection between a compactor module and an extruder module, wherein the connection is open.

With reference to FIGS. 1, 4A-10D and 15A-19B, an extruder module 600 may be secured to the distal end of the compactor module 200 in exemplary embodiments of the densifier. In some exemplary embodiments, the extruder module 600 is releasably secured to the distal end of the compactor module 200 to allow an individual to access the compactor module 200 for inspection and/or cleaning of the compression screw 230 and/or other components located therein. In one example, the extruder module 600 may be hingedly attached to the compactor module 200, where a hinge 602 secures one side of the proximal end of the extruder module 600 to the distal end of the compactor module 200, and a pin 604 (see FIG. 15B) or other securing device releasably secures the other side of the extruder module 600 with the compactor module 200. Although the previous example uses a hinge to releasably secure the extruder module to the compactor module 200, other exemplary embodiments may use other securing means (e.g., locks, clamps, screws, etc.) to effectuate a releasable securement. To help prevent material loss, a gasket or similar device (not shown) may be positioned between the engaged portions of the extruder module 600 and compactor module 200.

Figures 18A, 18B, 18C, 18D, 18E:
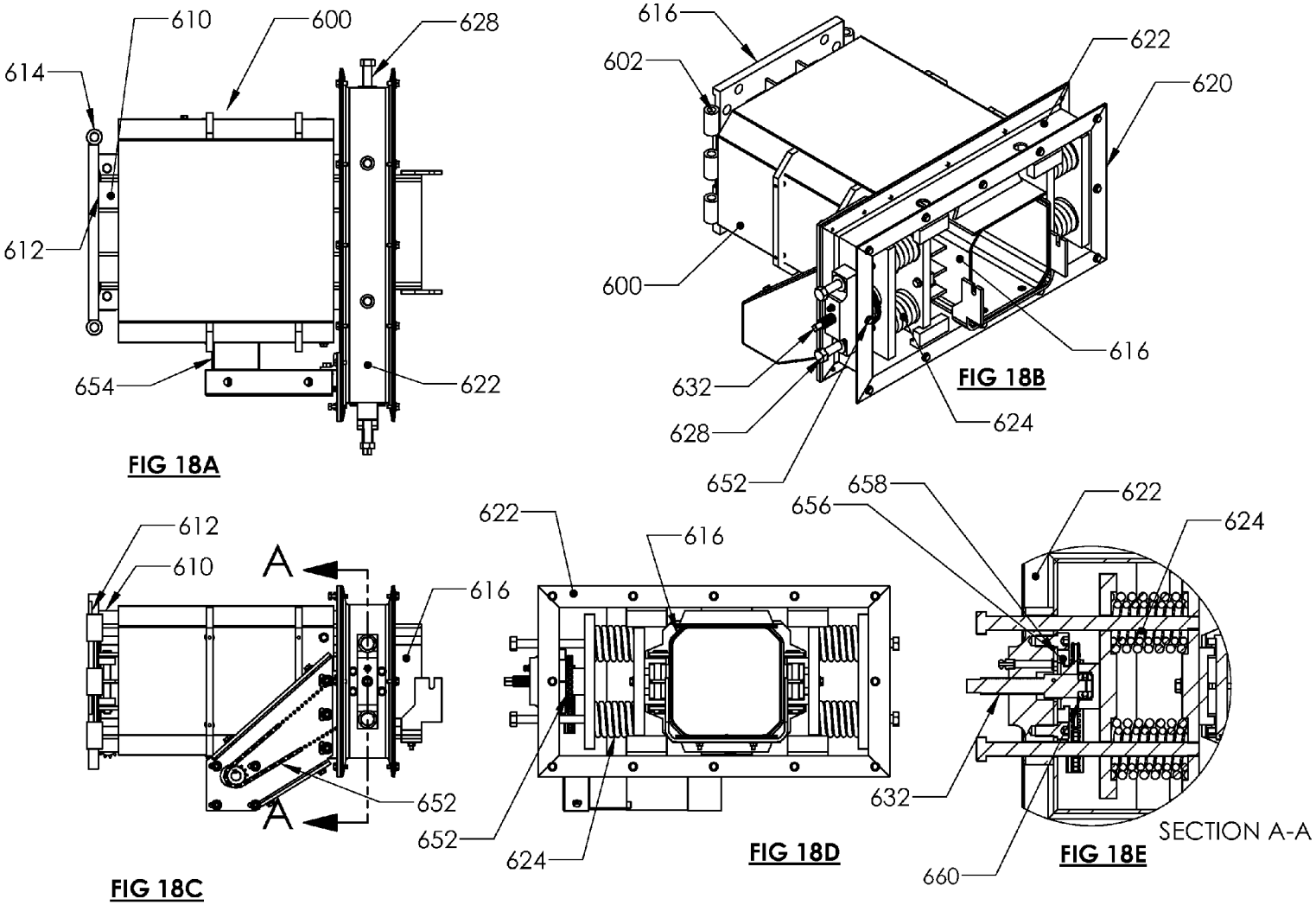
FIG. 18A is a top plan view of an extruder module that includes the adjustment system of FIG. 17A.
FIG. 18B is a perspective view of the extruder module of FIG. 18A.
FIG. 18C is a side elevation view of the extruder module of FIG. 18A.
FIG. 18D is a front elevation view of the extruder module of FIG. 18A.
FIG. 18E is a partial sectional view of the extruder module of FIG. 18C taken along the line E-E.
Figure 19A:
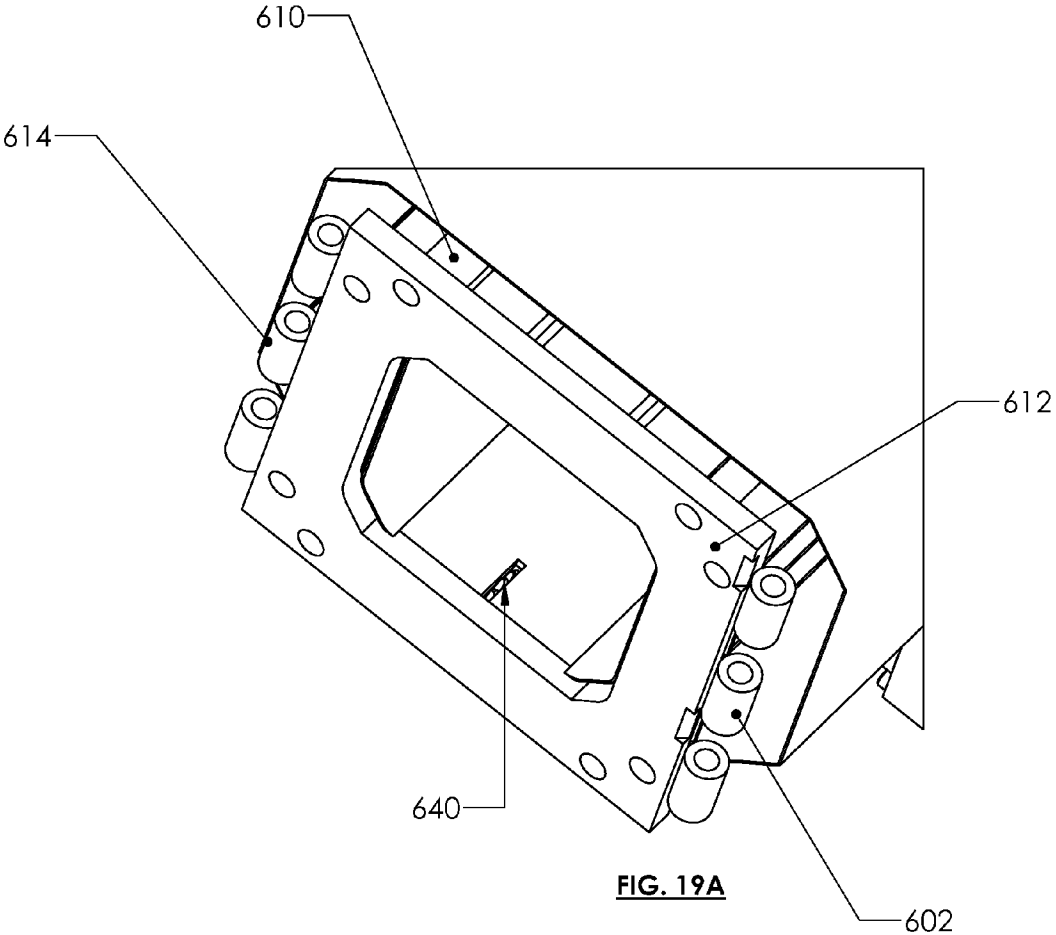
FIG. 19A is a partial perspective view of the proximal end of an exemplary embodiment of an extruder module that includes a speed sensor.
Figure 19B:
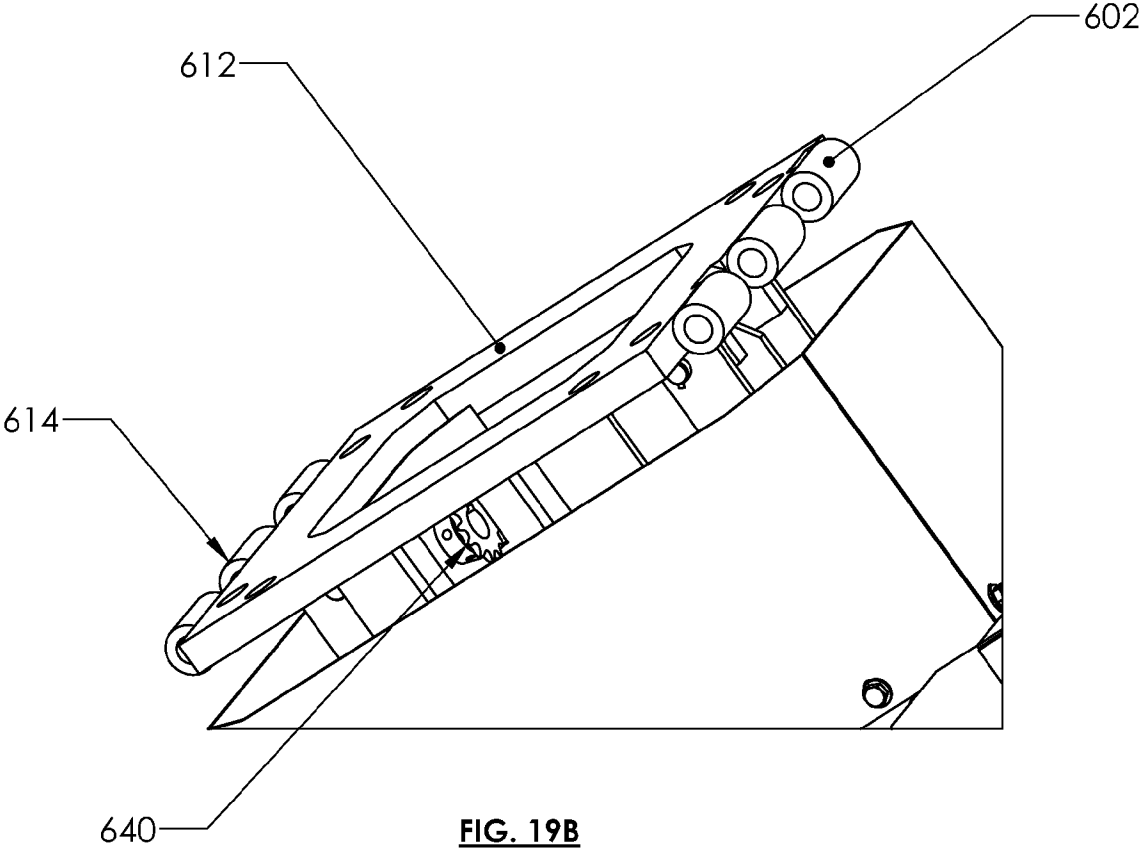
FIG. 19B is a bottom partial perspective view of the proximal end of an exemplary embodiment of an extruder module that includes a speed sensor.

Exemplary embodiments of the extruder module 600 may include a rail section 610, as seen in FIGS. 18C, 19A and 19B, that is secured to the compactor module 200 with an adapter plate assembly 612 at the proximal end of the extruder module. A pressure system 620 may be situated at the distal end of the extruder module 600, as seen in FIGS. 16A-16E. The adapter plate assembly 612 may include a hinge 602 and slots 614 for the pin attachment 604 between the extruder module 600 and the compactor module 200.

Figures 16A, 16B, 16C, 16D, 16E:
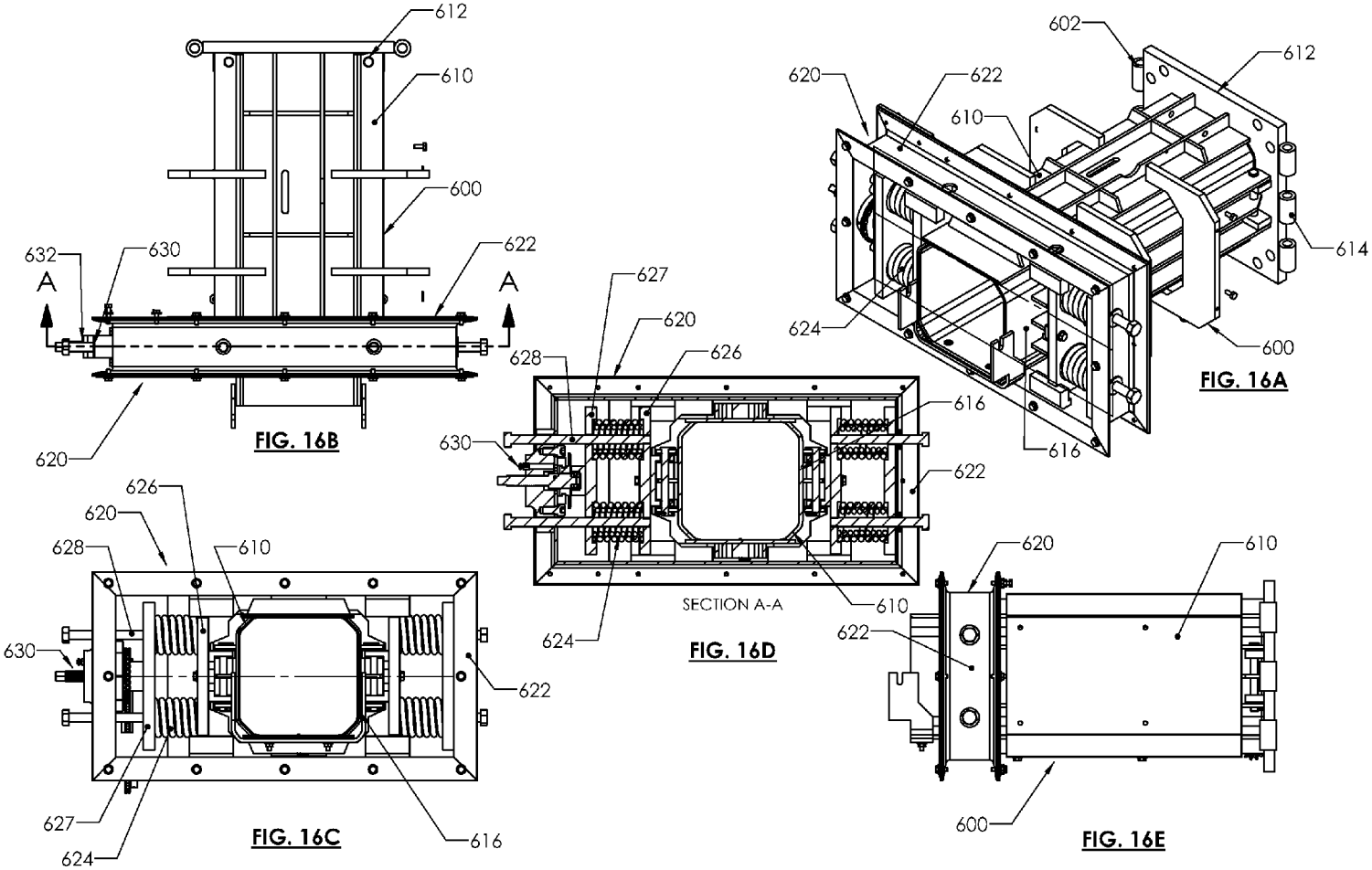
FIG. 16A is a perspective view of an exemplary embodiment of an extruder module.
FIG. 16B is a top plan view of an exemplary embodiment of an extruder module.
FIG. 16C is an elevation view of the distal end of an exemplary embodiment of an extruder module.
FIG. 16D is a sectional view of the exemplary embodiment of FIG. 16A taken along the line of D-D.
FIG. 16E is a side elevation view of an exemplary embodiment of an extruder module.
Figure 17B:
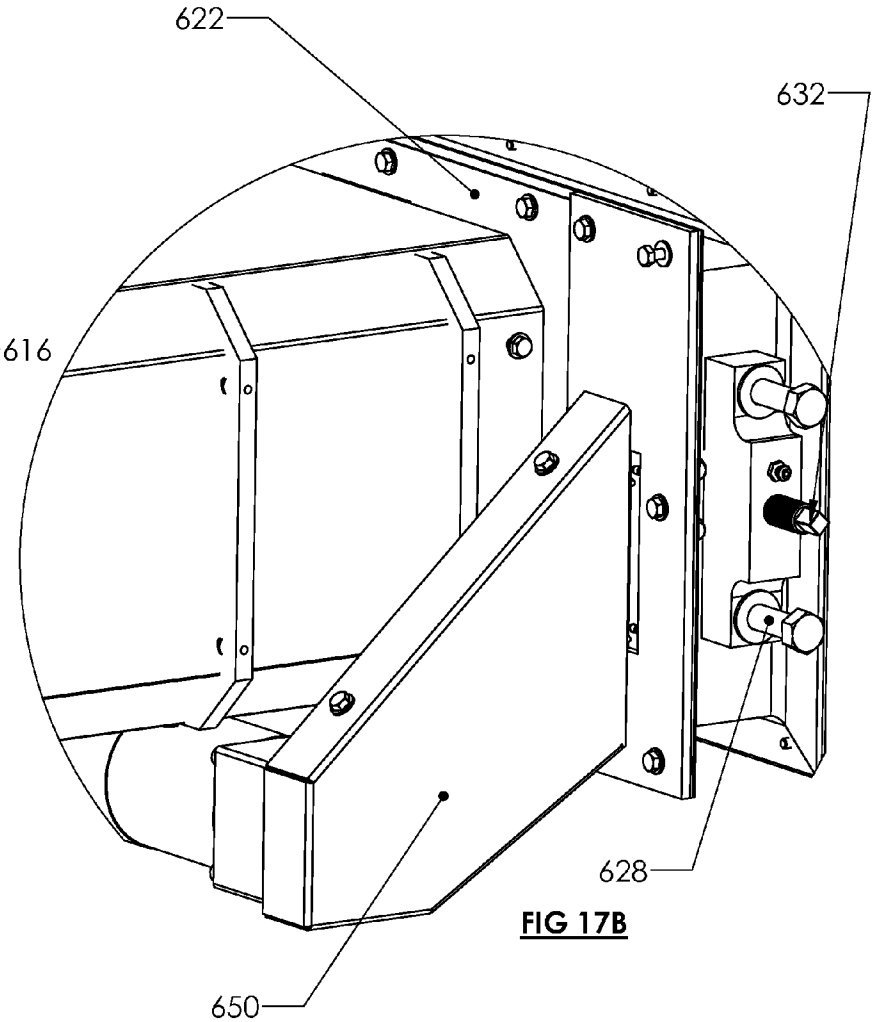
FIG. 17B is another partial perspective view of the adjustment system of FIG. 17A.
Figure 17A:
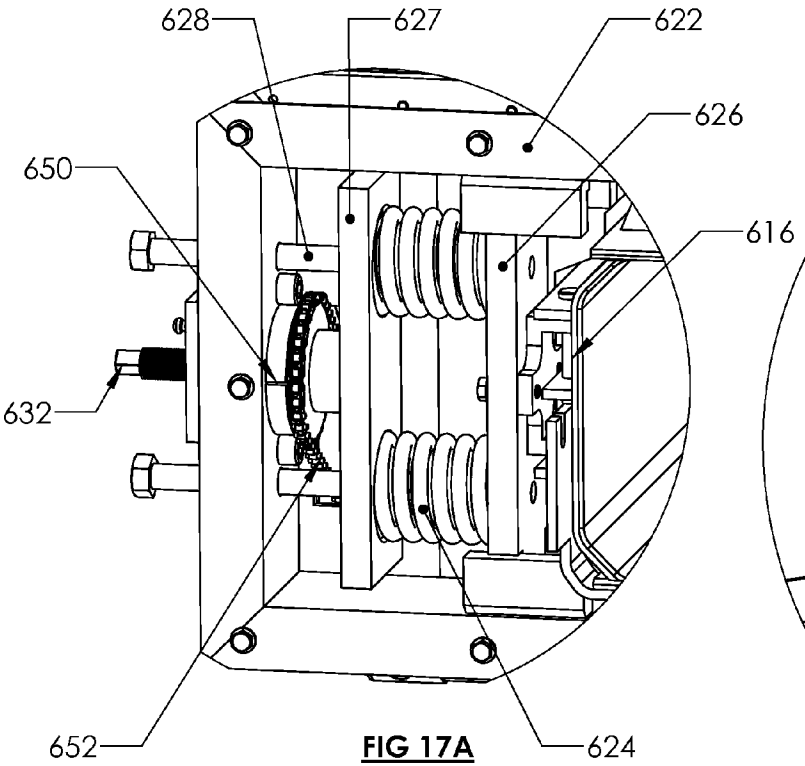
FIG. 17A is a partial perspective view of an exemplary embodiment of a system for adjusting a densifier.

In exemplary embodiments, the pressure system 620 may include a frame 622 that engages at least a portion of the rail section 610. In some embodiments, the frame 622 may engage at least the top and bottom faces of the rail section 610. In other exemplary embodiments, the frame 622 may engage only a portion of a face of the rail section 610 or may be associated in any suitable manner with the rail section 610. Exemplary embodiments of the pressure system 620 may further include at least one spring 624 secured between the frame 622 and the rail section 610. In some embodiments, two or more springs 624 may be situated and/or secured between the outer face of each side of the rail section 610 and the corresponding inner side face of the frame 622. In some embodiments, the springs 624 may be secured between plates 626 and 627 that facilitate securement to the frame 622 and the side walls 616 of the rail section, wherein at least one of the plates 627 may slide along at least one guide rail 628 that extends substantially between the inner side face of the frame 622 and an associated plate 626 wherein the plate 627 may include an aperture that allows the guide rail 628 to pass therethrough. Such as shown in these examples, a spring 624 may be situated around a guide rail 628. With the assistance of the springs 624, the side walls 616 of the rail section may be adapted to move to allow variability in the density of the material densified. In exemplary embodiments, the extruder module 600 may further include a compression system 630 that may vary the compression applied to the side walls 616 of the rail section 610. In one example, an adjustment or compression screw 632, as seen in FIG. 16B, is in mechanical association with the springs 624 and may be rotated or adjusted to increase and/or decrease the compression force applied by the springs 624 to the side walls 616 of the rail system 610. In the examples shown in FIGS. 16A-16E and 18A-18E, adjustment of the compression screw 632 (e.g., rotation of the compression screw 632) causes at least one plate 627 to move in or out with respect to a side wall 616, wherein springs 624 adjust to the force and cause plates 626 and associated side walls 616 to self center around the extruded bale or log.

An example of the compression system 630 that uses a compression screw 632 to adjust the spring compression force applied to the side walls may be environmentally friendly, when compared to other known methods of compacting materials. In other exemplary embodiments, other devices may be substituted to increase or decrease the compression force applied to the side walls 616 of the rail system 610. In one other example, a hydraulic system (not shown) may be used to vary the compression force applied to the rail system. A hydraulic system may not typically be as environmentally friendly due to the potential leakage of hydraulic fluid. In another example, a pin, clamp, or other suitable adjustable mechanism may be used to control the adjustment of the compression system 630.

Although the bales and/or logs of densified material produced by this particular embodiment are substantially rectangular in cross-section, other exemplary embodiments of the extruder module 600 may produce bales and/or logs with different cross-sectional geometries. Furthermore, although only the side walls of the rail section move in the aforementioned embodiments, other embodiments may allow all of the walls of the rail section to move in response to the pressure system 620. Other suitable variations may also be possible in light of these teachings.

It is possible to associate the densifier 10, or a portion thereof, with one or more devices that may facilitate the production of the bales and/or logs of material that have a common, desired density. In some embodiments, the devices may be automated. In one example, a speed sensor 640, such as seen in the examples of FIGS. 19A and 19B, may be associated with at least a portion of the extruder module 600 for tracking the speed of the bale and/or log produced. The speed sensor 640 may be a wheel sensor or other similar sensor that is able to track the speed and/or position of the bale or log in the extruder module 600. The speed sensor 640 may be in electrical communication with a control system 645 (e.g., a processor, PLC, or other computing device) that may vary the speed of the compression screw 230 and/or the dimensions of the rail section 610 of the pressure system 620 to achieve and/or maintain a desired density of the densified material. Such as shown in the example of FIG. 1, the control system 645 may be situated in the electrical junction box 300, or another location on the densifier 10 or at a remote location away from the densifier 10.

An exemplary embodiment of an adjustment system and method may be fully or substantially automated. FIGS. 17A through 18E show one example of an automated adjustment system. In this example, a motorized gear system 650 is adapted to automatically rotate the aforementioned compression screw 632 that may increase and/or decrease the compression force applied by the springs 624 to the side walls 616 of the rail system 610. In particular, this embodiment may be comprised of a rotatable chain 652 that is in association with a gear motor 654. The gear motor 654 may receive input from the control system 645 that monitors the speed, power to, or torque of the compression screw 632 and/or the speed of the output through the extruder module 600. If the control system 645 recognizes that any of the aforementioned variables are changing beyond a certain level, the control system 645 may send an input signal to the gear motor 654 to cause it to adjust components of the extruder module 600 to achieve a desired bale or log output. For example, the gear motor 654 may induce clockwise or counter-clockwise rotation of the compression screw 632 to create a different size outlet for the extruder module 600 (e.g., to adjust the aforementioned rails by changing the compression force applied to the springs). The chain 652 may be in association with a rotatable output sprocket 656 that is in association with the compression screw 632. In one example, the output sprocket 656 may be rotatably secured by a sprocket retainer 658, and a thrust bearing 660 may facilitate the application of compression force by the compression screw 632. In light of this exemplary embodiment, it should be recognized that various other known rotary actuators (e.g., multi-positional, stepping, indexing, etc.), worm gears, other gearing systems, or other suitable devices may be used to induce rotation.

In another example, the speed sensor 640 may work in conjunction with the control system 645 and other components of the extruder module 600 to produce predetermined lengths of bales or logs. The feed rate of densified material may be monitored by the speed sensor 640, wherein the input signal provides a predetermined length in whatever unit of measurement is desired, such as, for example, inches or millimeters, for the bale or log length. The predetermined length may be set within the control system 645, so that the control system may automatically stop and reverse the rotation of the compression screw 230, so as to set a break point in the baled log or bale. While or after the compression screw 230 has been reversed, the counter on the control system 645 may be reset for the next log or bale, continuing the forward operation of the compaction screw 230.

In another example, the compactor module 200 may optionally include temperature sensors 662 that may monitor the temperature of the compression screw 230 and/or the temperature of the material and/or grinding chamber 210, rotary union 250, or other components that may be prone to heat, so as to minimize the chance of melting or plasticizing the materials being densified. The temperature sensors 662 may be in electrical communication with a control system 645 (e.g., a processor or other computing device) that may vary the speed of the compression screw 230 or stop the compression screw 230 if the temperature thereof reaches an unwanted temperature.

In some examples, multiple different types of the sensors described may be used in conjunction with the control system 645 to control the material flow rate of the densified material. In some exemplary embodiments, the pressure system 620 may be used in conjunction with thermal and amperage digital input signals in the control system 645 which then provide the signal to a variable frequency drive (VFD) 320 that is in association with the electric motor 310 and is able to adjust the speed of the compression screw 230 to assure the best volume output and quality of log or bale.

In another example, a pressure system 820 may be situated at the distal end of an extruder module 800, as seen in FIGS. 20A-20E. An adapter plate assembly 812 may include a hinge 802 and slots 814 for the pin attachment 804 between the extruder module 800 and the compactor module 200.

In this example, the pressure system 820 may include a frame 822 that engages at least a portion of a rail section 810. In some embodiments, the frame 822 may engage at least the top and bottom faces of the rail section 810. In other exemplary embodiments, the frame 822 may engage only a portion of a face of the rail section 810 or may be associated in any other suitable manner with the rail section 810. In this example, the pressure system 820 may further include at least one fluid spring 824 associated between the frame 822 and a side wall 816 of the rail section 810. In some embodiments, two or more fluid springs 824 may be associated between the outer face of each side wall 816 of the rail section 810 and the corresponding inner side face of the frame 822. Furthermore, at least one fluid spring 824 may be associated with each side wall 816 of the rail section. In one example wherein the side walls 816 form a substantially rectangular cross-section, at least one fluid spring 824 may be associated with each of the four side walls, allowing for adjustment of each of the side walls independently.

Figure 21:
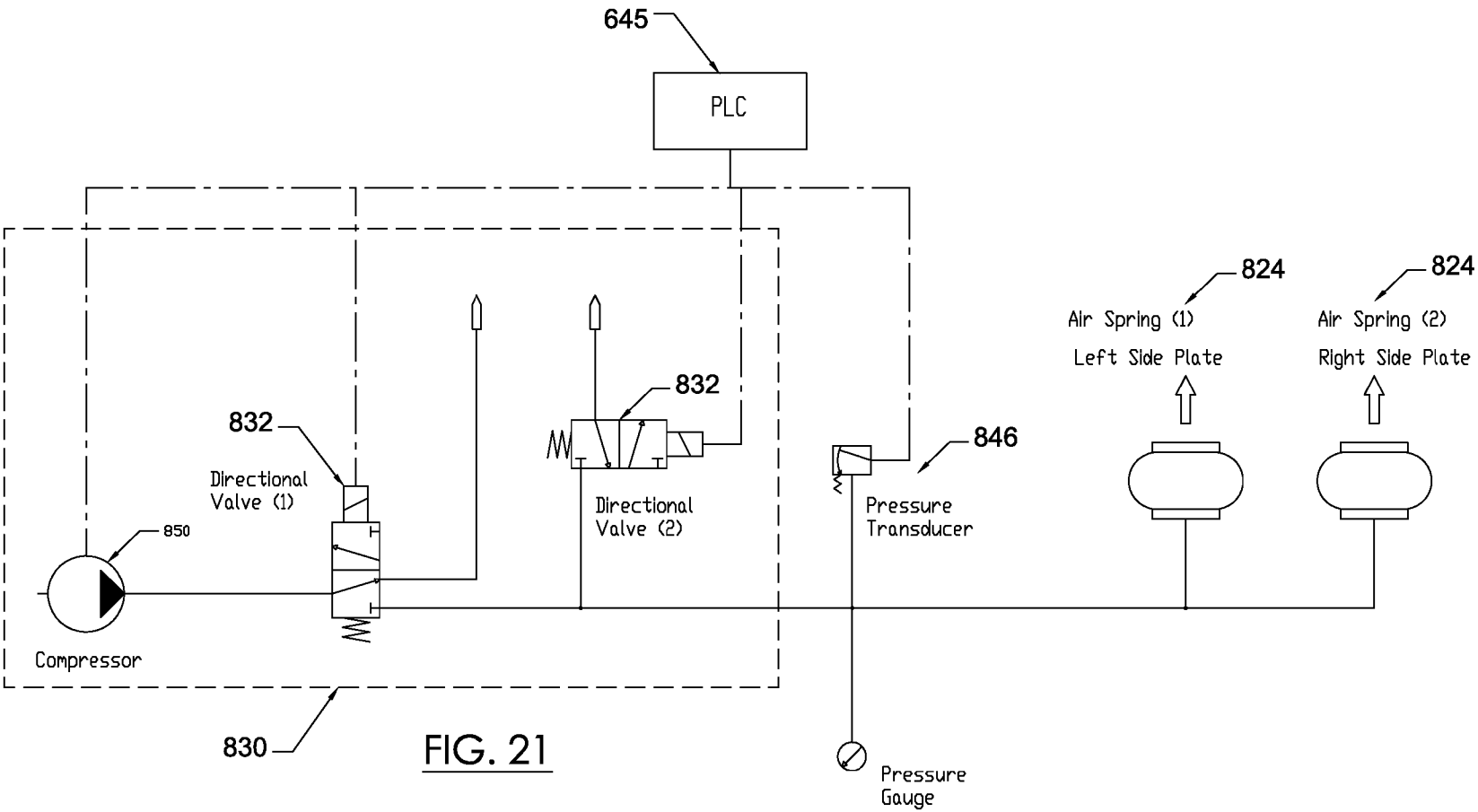
FIG. 21 is a schematic of one example that depicts how the components that control the pressure within the air springs may associate or communicate with the control system.

With the assistance of the at least one fluid spring 824, in one example, one or both of the side walls 816 of the rail section 810 may be adapted to move to allow variability in the density of the material densified. In exemplary embodiments, the extruder module 800 may further include a compression system 830 associated with the at least one fluid spring 824 that may increase and/or decrease the compression force applied by the at least one fluid spring 824 to the side wall 816 of the rail section 810. In one example of the compression system 830, at least one fluid spring valve 832, as seen in FIG. 21, is in fluid association with the at least one fluid spring 824. The at least one fluid spring valve 832 may be adapted to decrease the compression force applied by the at least one fluid spring 824 to the side walls 816 of the rail system 810.

Figure 20A:
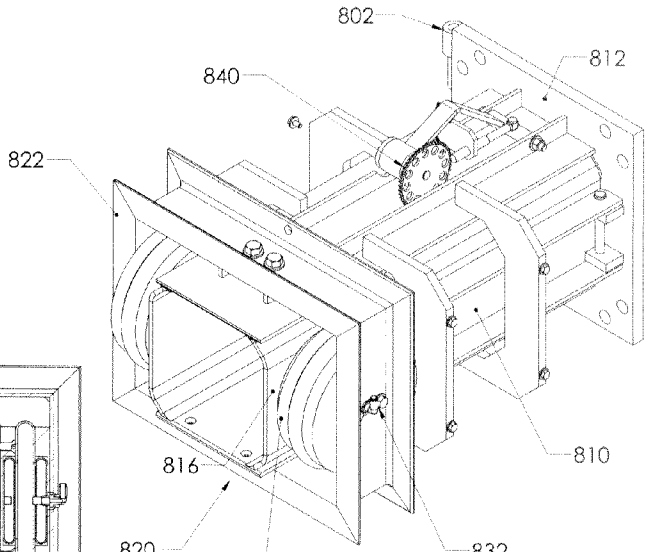
FIG. 20A is a perspective view of an exemplary embodiment of an extruder module.
Figure 20D:
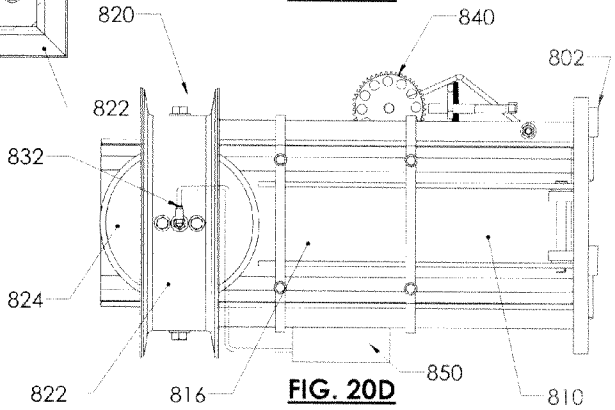
FIG. 20D is a side elevation view of an exemplary embodiment of an extruder module.

In exemplary embodiments, the rail section 810 or other components of the extruder module 800 may be at least partially covered by a cover guard (not shown). As seen in FIGS. 20A, 20B an 20D, one or more adapting bodies 840 may be placed at least partially around the rail section 810 or other components to facilitate the securement of one or more cover guards. In some embodiments, the one or more adapting bodies 840 may be associated with one or more brackets 844 that may be associated between the frame 822 of the pressure system 820 and/or a portion of the adapter plate assembly 812.

Figure 20E:
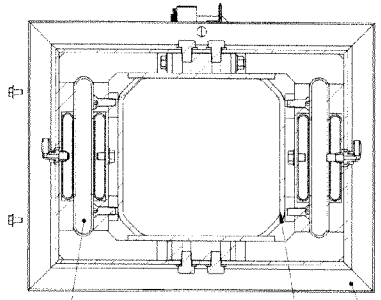
FIG. 20E is a sectional view of the exemplary embodiment of FIG. 20A taken along the line of A-A.
Figure 20B:
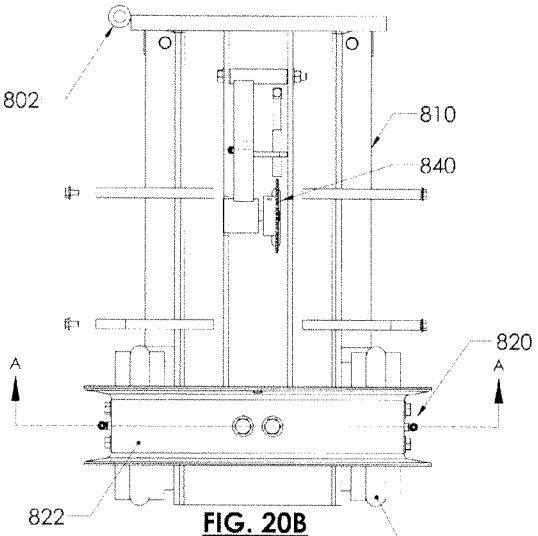
FIG. 20B is a top plan view of an exemplary embodiment of an extruder module.
Figure 20C:
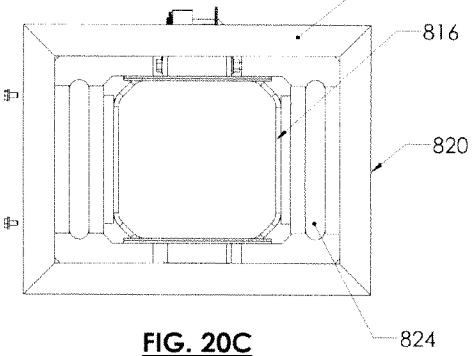
FIG. 20C is an elevation view of the distal end of an exemplary embodiment of an extruder module.

In one example of the compression system 830, at least one fluid compressor 850, as seen in FIG. 20E, is in fluid association with the at least one fluid spring 824. The at least one fluid compressor 850 may be adapted to increase the compression force applied by the at least one fluid spring 824 to the side walls 816 of the rail system 810.

In the examples shown in FIGS. 20A-20E, adjustment of the compression system 830 (e.g., inflation or deflation of the at least one fluid spring 824 causes at least one side wall 816 to move in or out with respect to the frame 822, wherein the at least one fluid spring 824 adjusts the force and causes the side walls 816 to self center about the extruded bale or log. In embodiments that include at least one fluid spring 824 that is associated with each side wall 816, one fluid compressor 850 and one fluid spring valve 832 may simultaneously control the increase and/or decrease in pressure contained within all or some of the fluid springs 824.

An example of the compression system 830 that uses at least one fluid spring valve 832 and/or one fluid compressor 850 to adjust the compression force applied to the side walls may be environmentally friendly, when compared to other known methods of compacting materials. The fluid utilized in exemplary embodiments of the compression system 830 may be air. However, in other embodiments, the compression system 830 may use additional or other optional fluids, such as, but not limited to: water, oils, pneumatic, hydraulic, or other fluids.

In other exemplary embodiments, other devices may be substituted to increase or decrease the compression force applied to the side walls 816 of the rail system 810. In one other example, a hydraulic system (not shown) may be used to vary the compression force applied to the rail system. A hydraulic system may not typically be as environmentally friendly due to the potential leakage of hydraulic fluid. In another example, a pin, clamp, or other suitable adjustable mechanism may be used to control the adjustment of the compression system 830.

Although the bales and/or logs of densified material produced by this particular embodiment are substantially rectangular in cross-section, other exemplary embodiments of the extruder module 800 may produce bales and/or logs with different cross-sectional geometries. Furthermore, although only the side walls 816 of the rail section 810 move in the aforementioned embodiments, other embodiments may allow all of the walls of the rail section to move in response to the compression system 830. Additionally, in the example seen in FIG. 20A, the side walls 816 are associated with the adapter plate assembly 812 towards the proximal end of the extruder module 800. In this embodiment, the side walls 816 may be pivotably associated with the adapter plate assembly 812, so that proximal end of the side walls 816 are securedly affixed to the adapter plate assembly 812, while the remainder of the side wall may rotate in relation to the affixed proximal end. Other suitable variations may also be possible in light of these teachings.

It is possible to associate the densifier 10, or a portion thereof, with one or more devices that may facilitate the production of the bales and/or logs of material that have a common, desired density. In some embodiments, the devices may be automated. In one example, a speed sensor 840, such as seen in the examples of FIGS. 20A-20E, may be associated with at least a portion of the extruder module 800 for tracking the speed of the bale and/or log produced. The speed sensor 840 may be a wheel sensor or other similar sensor that is able to track the speed and/or position of the bale or log in the extruder module 800. The speed sensor 840 may be in electrical communication with a control system 645 (e.g., a processor, PLC, or other computing device) that may vary the speed of the compression screw 230 and/or the dimensions of the rail section 810 of the pressure system 820 to achieve and/or maintain a desired density of the densified material. Such as shown in the example of FIG. 1, the control system 645 may be situated in the electrical junction box 300, or another location on the densifier 10 or at a remote location away from the densifier 10.

FIG. 21 is a schematic of one example that depicts how the components that control the pressure within the air springs associate or communicate with the control system 645 (PLC). The PLC 645 may be in wireless or hard-wired communication with the different components of the pressure system 820, compression system 830, speed sensor 840, temperature sensor 862, and/or motor 310. In this example, the PLC 645 is in communication with the least one fluid compressor 850, the at least one fluid spring valve 832 and a pressure sensor 846, such as a pressure transducer. The pressure sensor 846 may be associated with a fluid line (not shown) that connects the at least one fluid spring valve 832 and the at least one fluid air spring 824. In this example, the at least one compressor 850 is in fluid connection with the at least one fluid spring valve 832 that regulates the flow of fluid to and from the at least one fluid air springs 824.

In operation, in one example, the PLC 645 may take a reading from the pressure transducer 846. Depending upon the pressure reading, the PLC 645 may communicate with the at least one fluid spring valve 832 to release fluid pressure within the fluid line, which in turn reduces the amount of force applied by the at least one air spring 824 to the side wall 816. Likewise, the PLC 645 may communicate with the at least one compressor 850 to operate and add fluid pressure to the fluid line, which in turn increases the amount of force applied by the at least one air spring 824 to the side wall 816.

An exemplary embodiment of an adjustment system and method may be fully or substantially automated. FIGS. 20A through 20E show one example of an automated adjustment system. In this example, at least one fluid compressor is adapted to provide fluid pressure to the at least one fluid spring 824 to automatically increase and/or decrease the compression force applied therefrom to the side walls 816 of the rail system 810. In particular, this embodiment may be comprised of at least one fluid hose adapted to supply fluid to the at least one fluid spring 824. The at least one fluid compressor and/or the at least one fluid spring valve 832 may receive input from the control system 645 that monitors the speed, power to, or torque of the compression screw 230 and/or the speed of the output through the extruder module 800. If the control system 645 recognizes that any of the aforementioned variables are changing beyond a certain predetermined level, the control system 645 may send an input signal to the at least one fluid compressor to cause inflation of the at least one fluid spring 824. Similarly, the control system 645 may send an input signal to the at least one fluid spring valve 832 to cause deflation of the at least one fluid spring 824 to adjust the dimensions of the side walls 816 of the extruder module 600 to achieve a desired bale or log output. In light of this exemplary embodiment, it should be recognized that various other known pneumatic devices or other suitable devices may be used to induce movement of the side walls 816.

In another example, the speed sensor 840 may work in conjunction with the control system 645 and other components of the extruder module 800 to produce predetermined lengths of bales or logs. The feed rate of densified material may be monitored by the speed sensor 840, wherein the input signal provides a predetermined length in whatever unit of measurement is desired, such as, for example, inches or millimeters, for the bale or log length. The predetermined length may be set within the control system 645, so that the control system may automatically stop and reverse the rotation of the compression screw 230, so as to set a break point in the baled log or bale. While or after the compression screw 230 has been reversed, the counter on the control system 645 may be reset for the next log or bale, continuing the forward operation of the compaction screw 230.

In another example, the compactor module 200 may optionally include temperature sensors 862 that may monitor the temperature of the compression screw 230 and/or the temperature of the material and/or grinding chamber 210, rotary union 250, or other components that may be prone to heat, so as to minimize the chance of melting or plasticizing the materials being densified. The temperature sensors 862 may be in electrical communication with a control system 645 (e.g., a processor or other computing device) that may vary the speed of the compression screw 230 or stop the compression screw 230 if the temperature thereof reaches an unwanted temperature.

In some examples, multiple different types of the sensors described may be used in conjunction with the control system 645 to control the material flow rate of the densified material. In some exemplary embodiments, the pressure system 620 may be used in conjunction with thermal and amperage digital input signals in the control system 645 which then provide the signal to a variable frequency drive (VFD) 320 that is in association with the electric motor 310 and is able to adjust the speed of the compression screw 230 to assure the best volume output and quality of log or bale.

In some exemplary embodiments, the rail section 610 of the extruder module 600 may be supported by a support rail 670 that is attached to and supported by at least one support post 672. Additionally, in some exemplary embodiments, a ground body 674, as seen in FIG. 5, may attach to the support post 672 and may add stability to the support rail 670 when securing the support rail 670 to the ground.

Figure 10A:
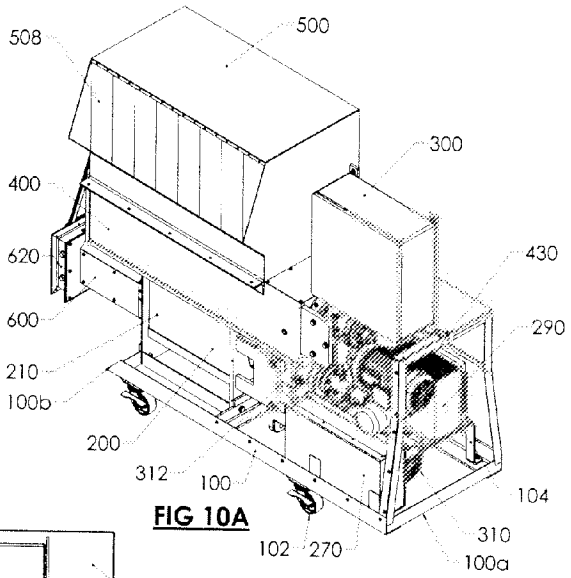
FIG. 10A is a perspective view of an exemplary embodiment of a densifier that includes a cooling system with the support rail in the upright position.
Figure 10D:
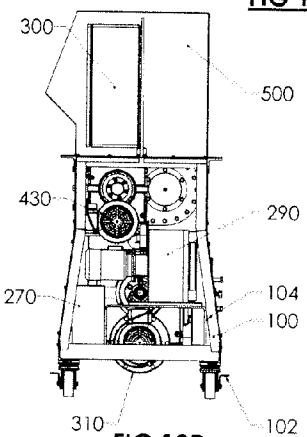
FIG. 10D is a front elevation view of an exemplary embodiment of a densifier that includes a cooling system with the support rail in the upright position.
Figure 10C:
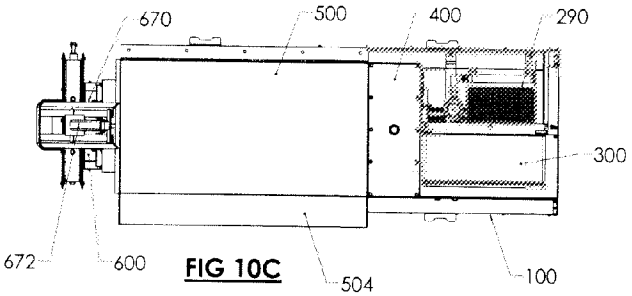
FIG. 10C is a top plan view of an exemplary embodiment of a densifier that includes a cooling system with the support rail in the upright position.
Figure 10B:
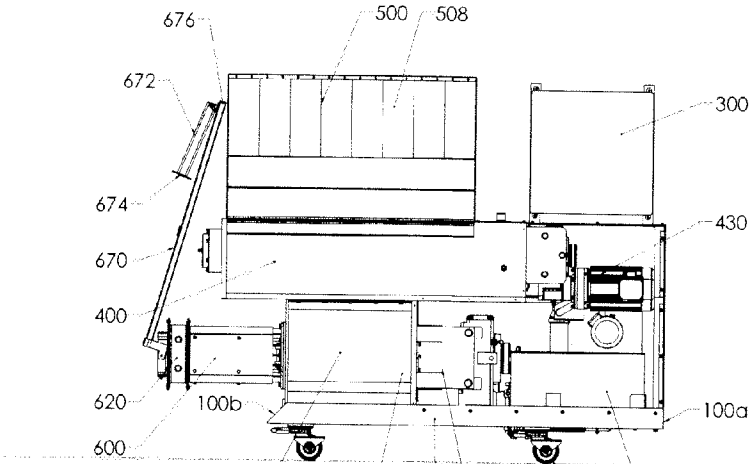
FIG. 10B is a side elevation view of an exemplary embodiment of a densifier that includes a cooling system with the support rail in the upright position.
Figure 11A:
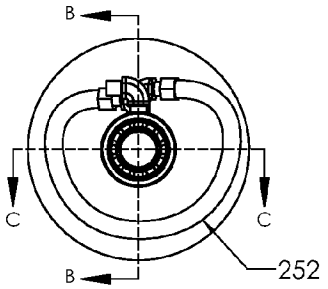
FIG. 11A is a front elevation view of an exemplary embodiment of a compression screw and rotary union.
Figure 11B:
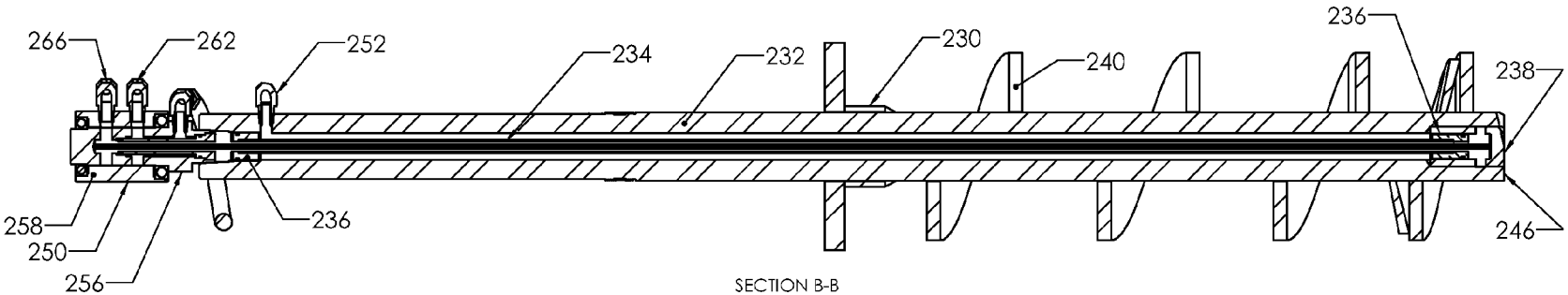
FIG. 11B is a sectional view of the compression screw and rotary union of FIG. 11A taken along the line B-B.
Figure 11C:
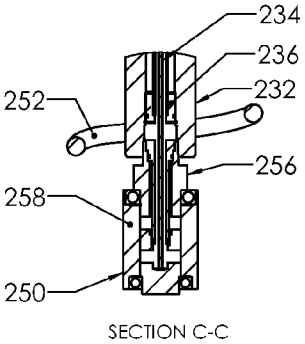
FIG. 11C is a partial sectional view of the proximal end of the compression screw and rotary union of FIG. 11A taken along the line C-C.

In exemplary embodiments, the ground body 674 may be adapted to be secured to various surfaces, including, but not limited to: wood, concrete, brick, and various ground terrains. In some exemplary embodiments, the support rail 670 is hingedly attached 676 to the distal end of the extruder module 600 so that the support rail 670 may be raised during the relocation of the densifier, as seen in FIGS. 10A-C. However, in other exemplary embodiments, the support rail 670 may be permanently mounted to various surfaces.

Exemplary embodiments of the densifier 10 may include an enclosure 700 that covers the motor 310 and/or reducer 312, the heat exchanger 290 and fluid reservoir 270, as seen in FIGS. 4B, 4C and 5. The enclosure 700 may be mounted to the frame 100 or brackets 104 extending from the frame. Exemplary embodiments of the enclosure 700 may include one or more access panels that allow an individual to access the components contained therewithin. The access panels may be positioned wherever it is desired to access the components within the enclosure.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A system for monitoring a temperature of and adjusting a densifier having a compression screw, comprising:

at least one temperature sensor configured to monitor a temperature of or adjacent to the compression screw; and a control system in electrical communication with a motor and the at least one temperature sensor, the control system configured to vary a speed or stop the compression screw based on input from the at least one temperature sensor;

wherein the compression screw includes:

a hollowed shaft;

a tubular body extending through a proximal end portion to a distal end portion of the hollowed shaft for transferring a cooling fluid; and at least one flight including a chamber in fluid connection with the tubular body and the hollowed shaft, wherein the cooling fluid is adapted to flow through the tubular body, the chamber, and the hollowed shaft such that the at least one flight is configured to be cooled by the cooling fluid.

2. The system of claim 1, wherein the at least one flight is situated at or relatively closest to a distal end of the compression screw in comparison to any other flight.

3. The system of claim 1, wherein the control system is adapted to vary the speed or amount of cooling fluid flowing through the compression screw.

4. The system of claim 1, wherein the cooling fluid is adapted to be circulated from the tubular body through the chamber and into the hollowed shaft about the tubular body.

5. The system of claim 1, wherein the at least one flight has a flattened end at a distal end in relationship with a flat end of the hollowed shaft.

6. The system of claim 1, wherein the system is adapted to use thermal or amperage input signals of the control system to provide a variable frequency drive in association with an electric motor to adjust the speed of or stop the compression screw.

7. The system of claim 1, wherein the at least one temperature sensor is associated with a distal end portion of the compression screw.

8. The system of claim 1, wherein the at least one temperature sensor is associated with an interior face of a compactor module of the densifier.

9. The system of claim 1, wherein the control system is adapted to automatically reverse rotation of the compression screw at a set break point to produce a predetermined length of bale.

10. The system of claim 1, wherein the control system is adapted to automatically slow down or stop rotation of the compression screw when the temperature reaches a predetermined reference point.

11. A method for monitoring the a temperature of and adjusting a densifier having a compression screw comprising a hollowed shaft, a tubular body extending through a proximal end portion to a distal end portion of the hollowed shaft for transferring a cooling fluid, and at least one flight including a chamber in fluid connection with the tubular body and the hollowed shaft, wherein the cooling fluid is adapted to flow through the tubular body, the chamber, and the hollowed shaft such that the at least one flight is configured to be cooled by the cooling fluid, the method comprising the steps of:

providing a system comprising at least one temperature sensor configured to monitor a temperature of or adjacent to the compression screw, and a control system in electrical communication with a motor and the at least one temperature sensor, the control system configured to vary a speed or stop the compression screw based on input from the at least one temperature sensor;

operating the densifier such that material is densified by rotation of the compression screw;

acquiring temperature readings from the at least one temperature sensor; and adjusting a speed of or stopping the compression screw when the temperature reaches a predetermined reference point.

12. The method of claim 11, further comprising the step of:

reversing the rotation of the compression screw at a set break point to produce a predetermined length of bale.

13. The method of claim 11, further comprising the steps of:

providing a cooling fluid to use in the system; and circulating the fluid throughout the system during operation of the compression screw to cool the compression screw.

14. The method of claim 13, further comprising the step of:

fluctuating or stopping the amount of fluid circulating through the compression screw depending upon temperature readings acquired.

* * * * *